US008490957B2

(12) United States Patent
Nagasako et al.

(10) Patent No.: US 8,490,957 B2
(45) Date of Patent: Jul. 23, 2013

(54) CREASING APPARATUS AND IMAGE FORMING SYSTEM

(75) Inventors: Shuuya Nagasako, Kanagawa (JP); Hitoshi Hattori, Tokyo (JP); Takashi Saito, Kanagawa (JP); Naoyuki Ishikawa, Kanagawa (JP); Yuusuke Shibasaki, Kanagawa (JP); Akihiro Musha, Kanagawa (JP); Go Aiba, Miyagi (JP); Naoki Oikawa, Miyagi (JP); Hidetoshi Kojima, Miyagi (JP); Naohiro Kikkawa, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/270,279

(22) Filed: Oct. 11, 2011

(65) Prior Publication Data

US 2012/0086161 A1 Apr. 12, 2012

(30) Foreign Application Priority Data

Oct. 12, 2010 (JP) ..... 2010-229773

(51) Int. Cl.
*B65H 37/06* (2006.01)

(52) U.S. Cl.
USPC ..... 270/32; 270/45; 493/444; 493/445

(58) Field of Classification Search
USPC ..... 270/32, 37, 45; 493/444, 445
See application file for complete search history.

(56) References Cited

U.S. PATENT DOCUMENTS

| | | | | |
|---|---|---|---|---|
| 7,740,238 | B2 * | 6/2010 | Iijima et al. | 270/37 |
| 7,770,876 | B2 * | 8/2010 | Sasahara | 270/32 |
| 7,887,036 | B2 * | 2/2011 | Hayashi et al. | 270/58.07 |
| 7,913,988 | B2 * | 3/2011 | Awano | 270/45 |
| 7,950,647 | B2 * | 5/2011 | Iguchi et al. | 270/58.07 |
| 7,954,797 | B2 * | 6/2011 | Sasahara | 270/45 |
| 8,240,651 | B2 * | 8/2012 | Mitani | 270/37 |
| 8,322,701 | B2 * | 12/2012 | Hattori et al. | 270/45 |
| 2008/0211159 | A1 * | 9/2008 | Iijima et al. | 270/37 |
| 2009/0039585 | A1 * | 2/2009 | Hayashi et al. | 270/58.08 |
| 2010/0207314 | A1 | 8/2010 | Hattori et al. | |
| 2010/0320673 | A1 * | 12/2010 | Takata | 270/37 |
| 2011/0076081 | A1 | 3/2011 | Hattori et al. | |
| 2011/0130260 | A1 | 6/2011 | Kikkawa et al. | |

FOREIGN PATENT DOCUMENTS

| | | |
|---|---|---|
| JP | 3617936 B2 | 11/2004 |
| JP | 4179012 B2 | 9/2008 |
| JP | 4355255 B2 | 8/2009 |

OTHER PUBLICATIONS

Abstracts of Japanese Patent Publications JP 2000327208, JP 2005324933 and JP 2004284774.

* cited by examiner

*Primary Examiner* — Patrick Mackey

(74) *Attorney, Agent, or Firm* — Harness, Dickey & Pierce, P.L.C.

(57) ABSTRACT

A creasing apparatus that performs a creasing process on a sheet, the creasing apparatus including a first conveying path on which a creasing unit is located, the creasing unit performing a creasing process on a sheet conveyed therein; a second conveying path that conveys a sheet conveyed therein to a downstream side without any process being performed on the sheet; and a control unit that, while the first conveying path conveys a sheet so that the creasing unit performs the creasing process on the sheet, causes a subsequent sheet to be conveyed to the downstream side from the second conveying path.

13 Claims, 21 Drawing Sheets

CREASING APPARATUS AND IMAGE FORMING SYSTEM

CROSS-REFERENCE TO RELATED APPLICATIONS

The present application claims priority to and incorporates by reference the entire contents of Japanese Patent Application No. 2010-229773 filed in Japan on Oct. 12, 2010.

BACKGROUND OF THE INVENTION

1. Field of the Invention

The present invention relates to a creasing apparatus that performs a creasing process on a sheet-like member (hereafter, referred to as a "sheet" in this specification) that has been conveyed from upstream before the sheets are bound together as a pile at the center section thereof and folded in two about the center section, and the present invention further relates to an image forming system that includes the creasing apparatus and an image forming apparatus, such as a copier, printer, facsimile, or digital multifunction peripheral that has the functions of a copier, printer, and facsimile in combination.

2. Description of the Related Art

Conventionally, a pile of sheets is obtained by combining sheets that are discharged from an image forming apparatus, the sheets in the pile are then bound together at the center section thereof, and the pile of center-bound sheets is folded in two at the center section, i.e., what is called center-folding or center-folded bookbinding is performed. If sheets in a pile are folded as a whole, the folded area of the outer sheet of the pile is stretched to a larger degree than that of the inner sheet. Because the formed image area on the folded area of the outer sheet is stretched, damage such as toner coming off may occur on the image area. The same phenomenon occurs in other folding processes such as Z-folding or letter-folding. The sheets in a pile may be folded in an insufficient manner because of the thickness of the pile.

A creasing apparatus called a creaser is already known. Before a folding process such as a process for folding a pile of sheets in two is performed, the creasing apparatus forms a crease in advance on an area of a sheet that is to be folded so that even the outer sheet can be easily folded, which prevents toner from coming off the sheet. In such a creasing apparatus, a crease is formed on a sheet in the direction perpendicular to the conveying direction by using a method, such as driving a roller and burning with a laser or pressing with a creasing blade.

When a processing function is performing a process, any processing function that is upstream of the processing function is stopped. Because the process on the upstream side cannot be started unless the process on the downstream side is completed, the processing efficiency is decreased. An apparatus that has a configuration to enable these processes to be performed in parallel is known (see Japanese Patent No. 4179012, Japanese Patent No. 3617936, and Japanese Patent No. 4355255). While the processing function on the downstream side is being executed, sheets that are processed using the processing function on the upstream side are in a stand-by state or being held back and, when the process using the processing function on the downstream side is completed, the sheets processed on the upstream side are conveyed downstream all together for processing.

A sheet conveying apparatus is disclosed in Japanese Patent No. 4179012 that includes a first path that conveys a sheet; a second path that conveys a sheet to a post-processing unit; a third path that discharges a sheet without any post-processing being performed; a switching unit that switches between the second conveying path and the third conveying path; and a fourth path that retains a sheet on the upstream side of the switching unit. A mechanism is also disclosed in Japanese Patent No. 4179012 in which a sheet conveyed by the second conveying path is retained by the fourth conveying path, and the sheet conveyed from the first conveying path is stacked together with the sheet conveyed along the second conveying path so as to be delivered downstream for post-processing.

A technology is disclosed in Japanese Patent No. 3617936 and Japanese Patent No. 4355255 in which a sheet is held back on the upstream side and, after the processing on the downstream side is finished, the held sheet is conveyed or the held sheet is stacked together with another sheet and is conveyed.

Because a creasing process requires a certain period of time, there is a productivity limitation. If the creasing process is performed by a pressing method, productivity conditions are particularly difficult. As described above, a technology is known in which, if there is a sheet to be processed on the downstream side, one or more sheets are held back on the upstream side. Although it is tried to hold back a sheet while a process is being performed by combining these technologies, because a process performed on the upstream side is a creasing process, they can't be just applied as they are.

SUMMARY OF THE INVENTION

It is an object of the present invention to at least partially solve the problems in the conventional technology.

According to an aspect of the present invention, there is provided a creasing apparatus that performs a creasing process on a sheet, the creasing apparatus including a first conveying path on which a creasing unit is located, the creasing unit performing a creasing process on a sheet conveyed therein; a second conveying path that conveys a sheet conveyed therein to a downstream side without any process being performed on the sheet; and a control unit that, while the first conveying path conveys a sheet so that the creasing unit performs the creasing process on the sheet, causes a subsequent sheet to be conveyed to the downstream side from the second conveying path.

According to another aspect of the present invention, there is provided a creasing apparatus that performs a creasing process on a sheet; the creasing apparatus including a first conveying path on which a creasing unit is located, the creasing unit performing a creasing process on a sheet conveyed therein; a second conveying path that conveys a sheet conveyed therein to a downstream side without any process being performed on the sheet; and a control unit that, while the first conveying path conveys a sheet so that the creasing unit performs the creasing process on the sheet, causes a subsequent sheet to be temporarily stored on the second conveying path and then causes the subsequent sheet to be conveyed to the downstream side.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

In the embodiments that will be described later, a creasing apparatus is denoted by the reference mark A, a creasing unit which corresponds to a creasing mechanism is denoted by the reference mark C, a first conveying path is denoted by the reference mark H1, a second conveying path is denoted by the reference mark H2, a control unit is denoted by the reference mark CPU_PR1 or A1, a third conveying path is denoted by the reference mark H3, an image forming apparatus is denoted by the reference mark PR, a folding processing apparatus is denoted by the reference mark B, and an input unit which corresponds to an operation panel is denoted by the reference mark OP.

Exemplary embodiment of the present invention is explained in detail below with reference to the accompanying drawings.

Figure 1:
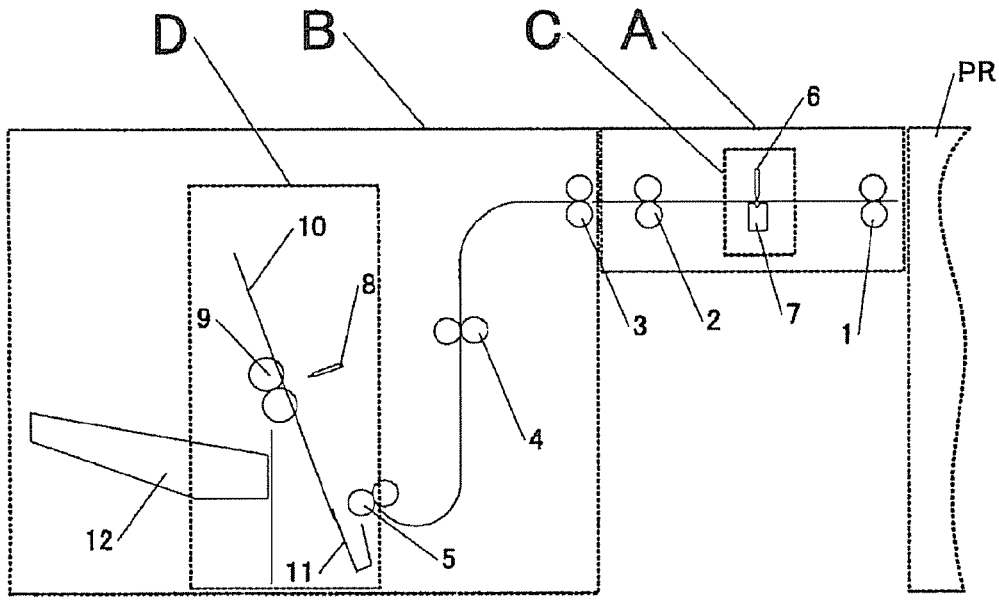
FIG. 1 is a diagram that illustrates a schematic configuration of an image forming system according to an embodiment of the present invention.

FIG. 1 is a diagram that illustrates a schematic configuration of an image forming system according to an embodiment of the present invention. The image forming system principally includes an image forming apparatus PR that forms images on a sheet; a creasing apparatus A that forms a crease; and a folding processing apparatus B that performs a folding process (post-processing).

The creasing apparatus A includes a first and a second conveying units 1 and 2 and a creasing mechanism C. The creasing mechanism C includes a creasing member 6 and a receiving board 7, and forms a crease on a sheet by sandwiching the sheet between the creasing member 6 and the receiving board 7. After a crease is formed by the creasing apparatus A, the sheet is fed to the folding processing apparatus B in downstream. The folding processing apparatus B includes a third, a fourth, and a fifth conveying units 3, 4, and 5, a center-folding device D, and a stacking tray 12. The conveying unit is made up of a conveying roller in the present embodiment.

The image forming apparatus PR receives image data from a scanner, a personal computer (PC), or the like, and develops and outputs the image data as a visible image on a sheet. A well-known image forming engine using an electrophotographic system, an ink-jet system, or the like, is used in the image forming apparatus PR.

The creasing apparatus A includes a conveying mechanism and the creasing mechanism C. The creasing mechanism C includes the creasing member 6 and the receiving board 7. A sheet is sandwiched between the creasing member 6 and the receiving board 7 so that a linear crease is formed on the sheet. A blade (a creasing blade, a convex blade) used for forming a crease, is located on the edge face of the creasing member 6 that is facing the receiving board 7. The blade is arranged in a linear fashion in the direction perpendicular to the sheet conveying direction. The creasing blade is formed in a cutting tooth form with a sharp edge. A creasing groove (a concave blade) is formed on a surface of the receiving board 7 that is facing the creasing blade so that an end edge of the creasing blade fits into the creasing groove. Because the creasing blade and the creasing groove are formed in the above-described shapes, a crease according to the edge shape (concave blade) and the groove shape (convex blade) is formed on a sheet when the sheet is sandwiched therebetween.

The folding processing apparatus B includes the center-folding device D that performs a folding process. After a crease is formed on a sheet by the creasing apparatus A, the sheet is conveyed to the folding processing apparatus B and then guided to the center-folding device D by the first, the second, and the third conveying units 3, 4, and 5 of the conveying mechanism.

The center-folding device D includes a center-folding processing tray 10; a trailing-edge fence 11 that is located at the lower end (on the most extreme upstream side in the conveying direction) of the center-folding processing tray 10; a folding plate 8 and a pair of folding rollers 9 that fold a sheet along a crease; and the stacking tray 12. The trailing-edge fence 11 aligns a sheet in the conveying direction. The trailing edge of the sheet discharged into the center-folding processing tray 10 is pushed against the trailing-edge fence 11 by the force of a not depicted return roller so that the position of the sheet is aligned. Furthermore, a sheet is aligned in a direction perpendicular to the conveying direction by a not depicted jogger fence.

The end edge of the folding plate 8 is pushed against a pile of aligned sheets along the crease so as to be pushed into a nip of the pair of folding rollers 9. Thus, the pile of sheets is pushed into the nip of the pair of folding rollers 9 so that a crease is formed due to the nip. If a center-binding process is also performed, after a binding process is performed by a not depicted binding apparatus on the area where a crease is formed, the above folding process, i.e., what is called a twofold process, is performed. The pile of twofold sheets is discharged and stacked in the stacking tray 12.

Figure 2:
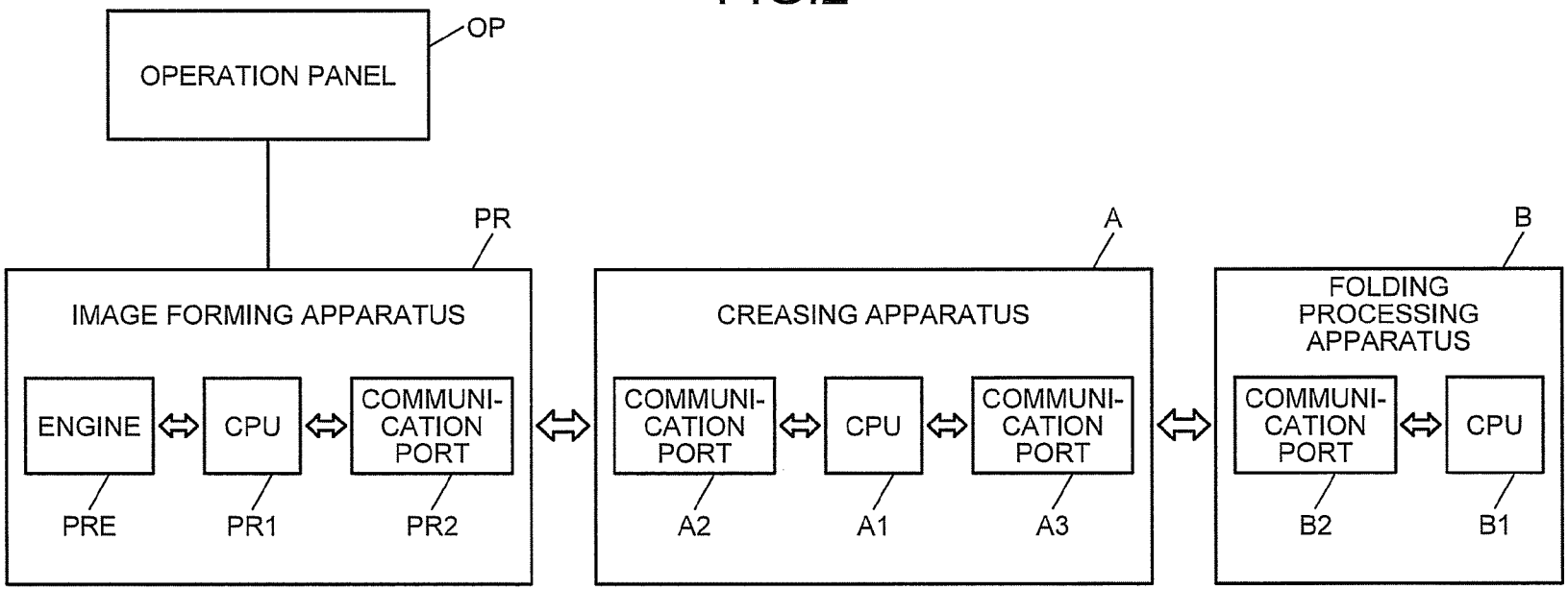
FIG. 2 is a block diagram that illustrates a control configuration of the image forming system according to the embodiment.

FIG. 2 is a block diagram that illustrates a control configuration of the image forming system according to the present embodiment. The image forming system according to the present embodiment includes the creasing apparatus A; the folding processing apparatus B that performs a folding process; and the image forming apparatus PR. The creasing apparatus A, the folding processing apparatus B, and the image forming apparatus PR include central processing units (CPU) A1, B1, and PR1, respectively. The CPU_PR1 of the image forming apparatus PR is connected to the CPU_A1 of the creasing apparatus A via a communication port PR2 of the image forming apparatus PR and a first communication port A2 of the creasing apparatus A such that they can communicate with each other. The CPU_A1 of the creasing apparatus A is connected to a CPU_B1 of the folding processing apparatus B via a second communication port A3 of the creasing apparatus A and a communication port B2 of the folding processing apparatus B such that they can communicate with each other. An engine PRE used for forming images is included in the image forming apparatus PR and the operation panel OP is connected to the image forming apparatus PR so as to function as a human-machine interface between the image forming system and a user.

Each of the apparatuses includes an I/O unit that controls input/output to/from a driver that drives each sensor, solenoid, motor, or the like, and is operated in response to instructions from a CPU. Each of the CPU_PR1, A1, and B1 loads into a not depicted random access memory (RAM) a program codes stored in a not depicted read-only memory (ROM), executes controls according to a program defined by the program codes while using the RAM as a work area and data buffer, and operates each unit through each of the above-described drivers. The CPU_PR1 of the image forming apparatus PR controls the overall system. The CPU_A1 and B1 of the creasing apparatus A and the folding processing apparatus B control each device according to instructions from the CPU_PR1 of the image forming apparatus PR and sends information necessary for control to the image forming apparatus PR.

Figure 3:
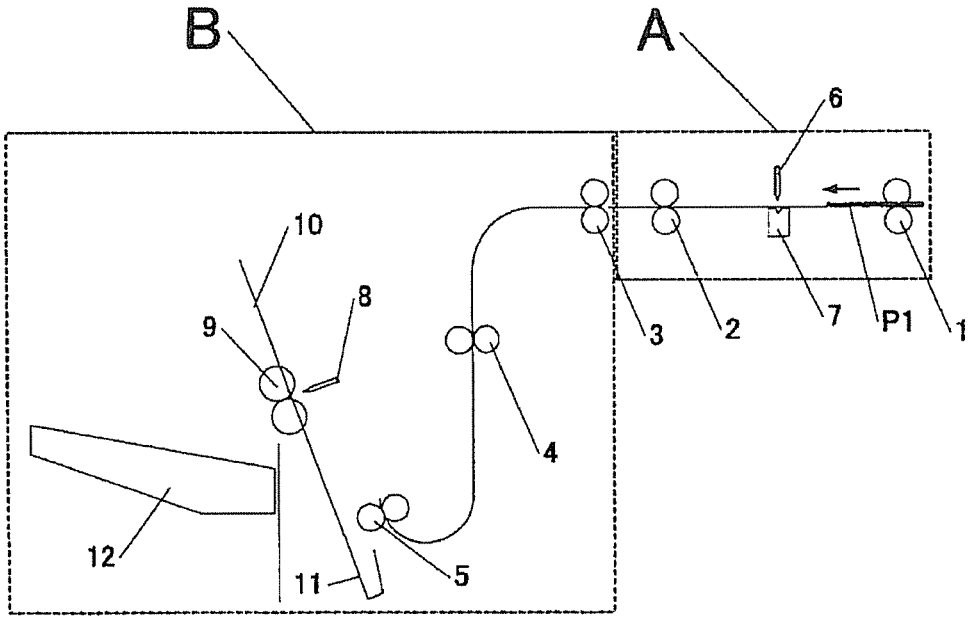
FIG. 3 is an operation explanatory diagram of the image forming system according to the embodiment and illustrates a state where a first sheet is conveyed to a creasing apparatus.
Figure 4:
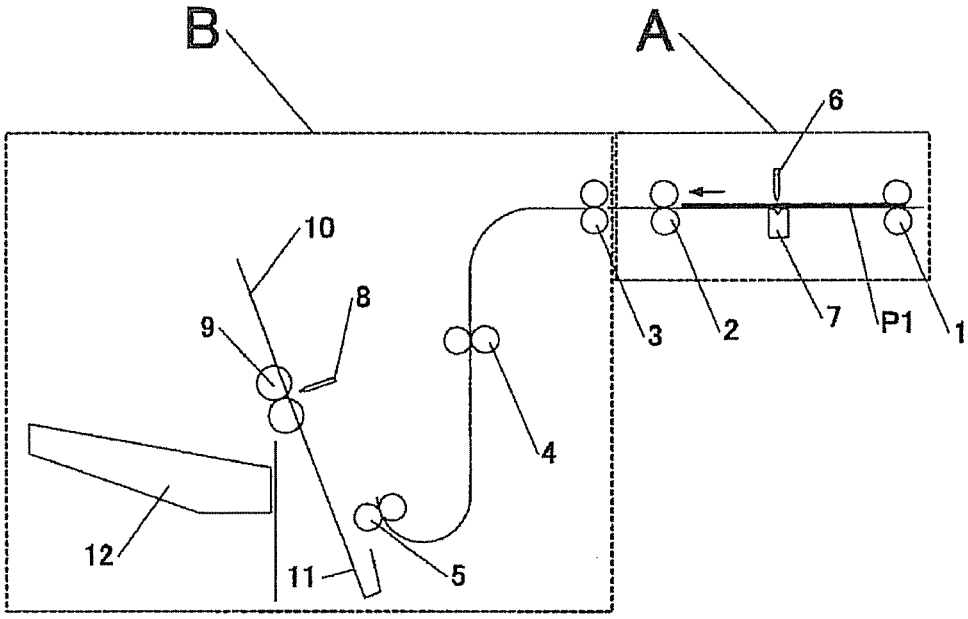
FIG. 4 is an operation explanatory diagram that illustrates a state just before a sheet is stopped to have a crease formed on it.
Figure 5:
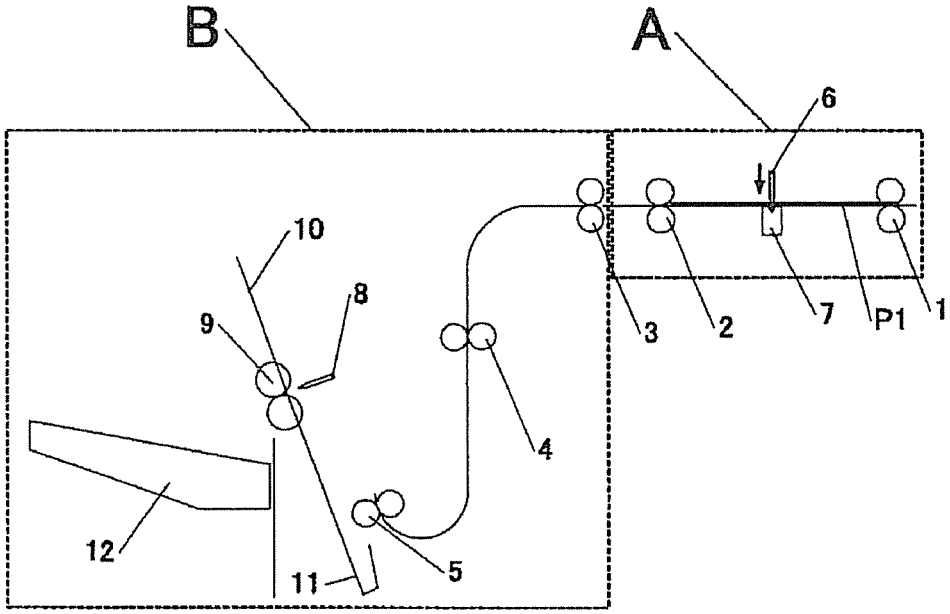
FIG. 5 is an operation explanatory diagram that illustrates a state during a creasing operation.
Figure 6:
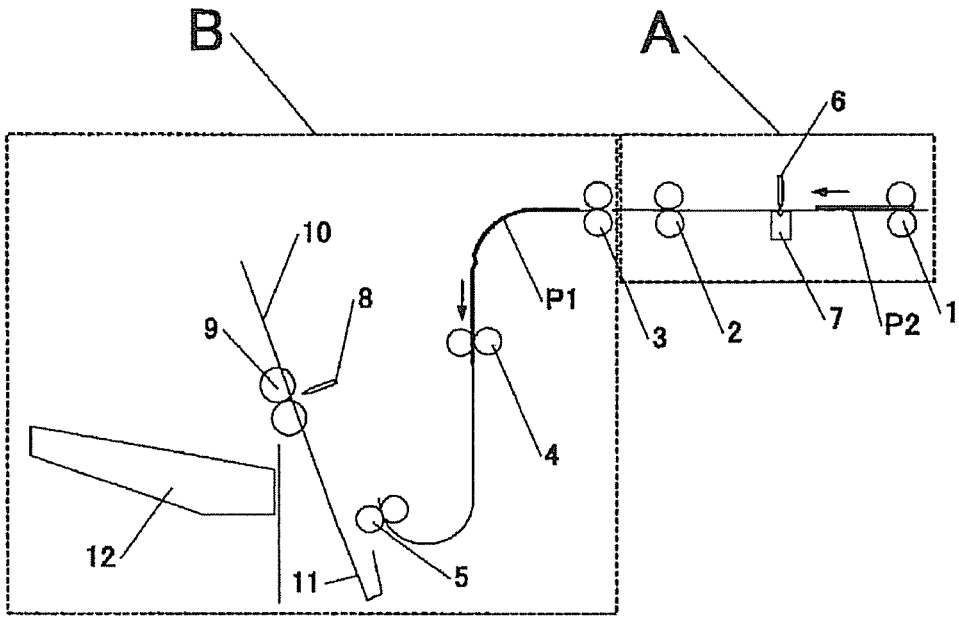
FIG. 6 is an operation explanatory diagram that illustrates a state where the first sheet is conveyed to a folding apparatus.

FIGS. 3 to 13 are explanatory diagrams that illustrate a sequence of operations including the folding process performed by the image forming system. In the image forming system, a sheet P1 on which images have been formed by the image forming apparatus PR is conveyed to the creasing apparatus A and then stopped at a position where a crease is to be formed (FIGS. 3 and 4). As illustrated in FIG. 5, when the sheet P1 is stopped at the position where a leading edge of the sheet P1 is in contact with a nip of the second conveying unit 2, the creasing member 6 is moved downward so that the sheet P1 is sandwiched between the creasing member 6 and the receiving board 7. Thus, a crease is formed on the sheet P1.

Figure 7:
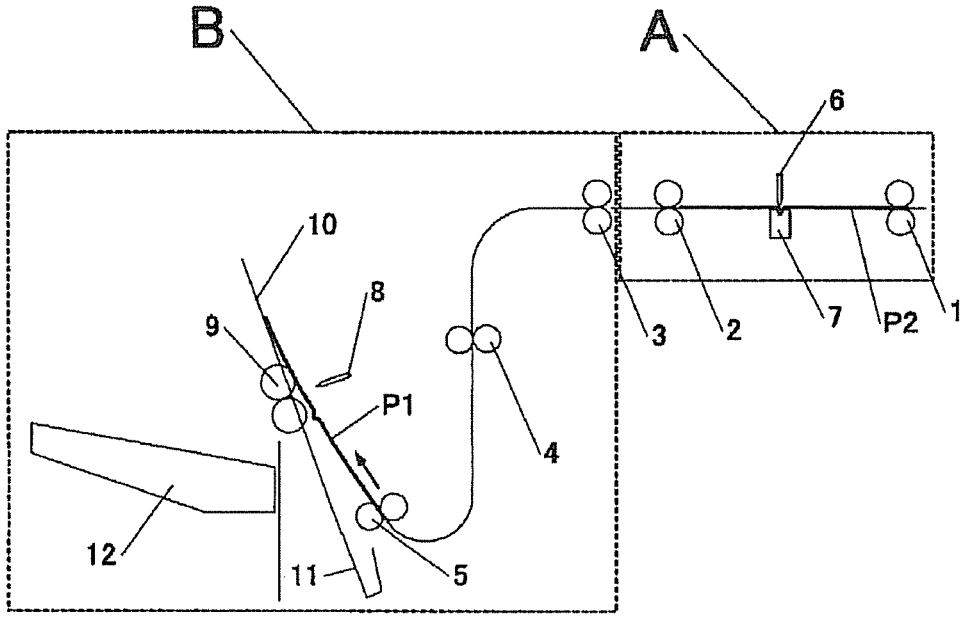
FIG. 7 is an operation explanatory diagram that illustrates a state where the first sheet is just about to be conveyed to a processing tray and a second sheet is being subjected to a creasing process in the creasing apparatus.
Figure 8:
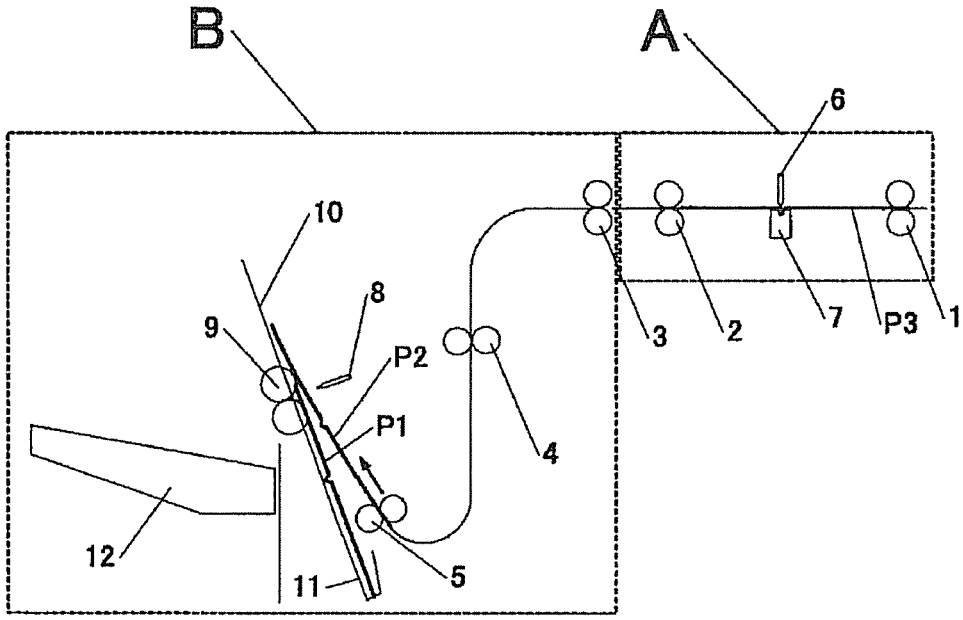
FIG. 8 is an operation explanatory diagram that illustrates a state where the first sheet has been conveyed to the processing tray, the second sheet is just about to be conveyed to the processing tray, and a third sheet is being subjected to a creasing process in the creasing apparatus.
Figure 9:
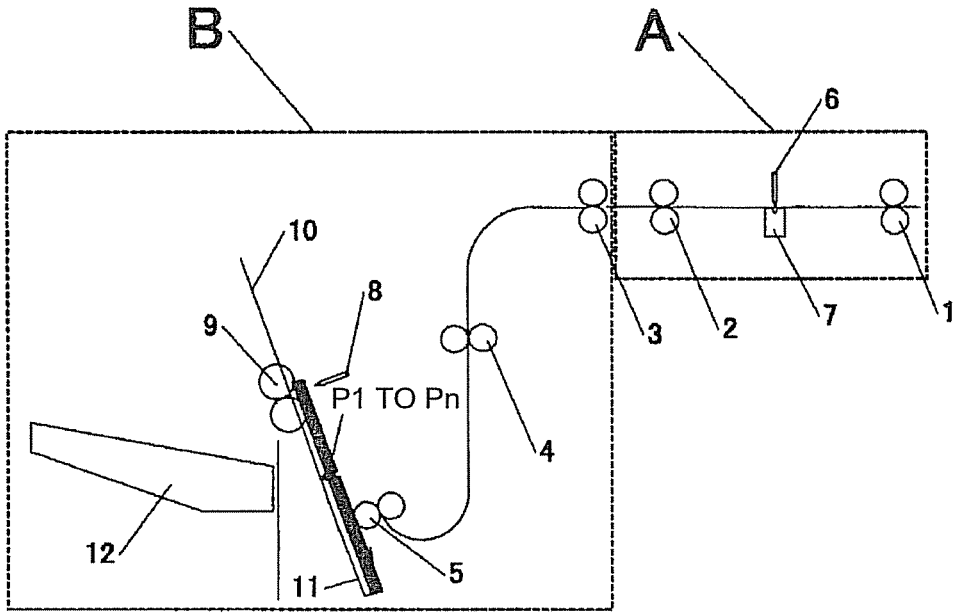
FIG. 9 is an operation explanatory diagram that illustrates a state where all sheets have been conveyed to the processing tray.
Figure 10:
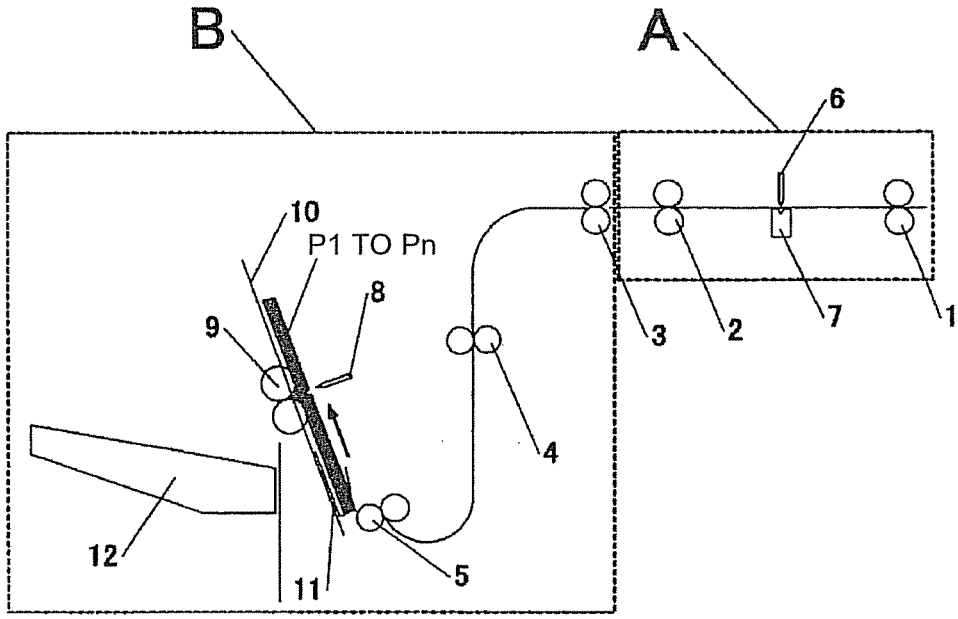
FIG. 10 is an operation explanatory diagram that illustrates a state where a pile of sheets is lifted up to a center-folding position.
Figure 11:
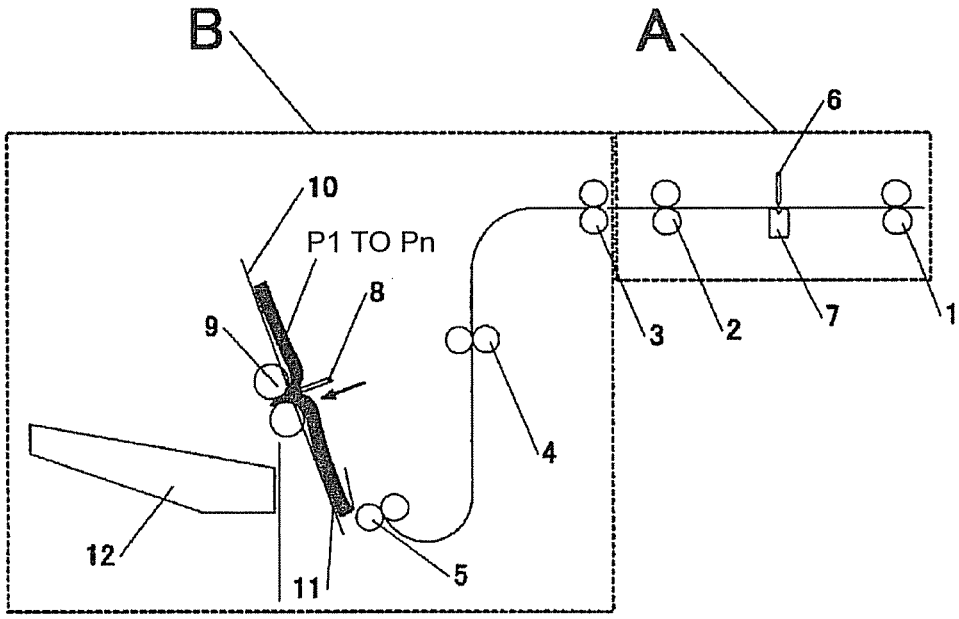
FIG. 11 is an operation explanatory diagram that illustrates a state where the pile of sheets is pushed into a nip of a pair of folding rollers by a folding plate at the center-folding position.
Figure 12:
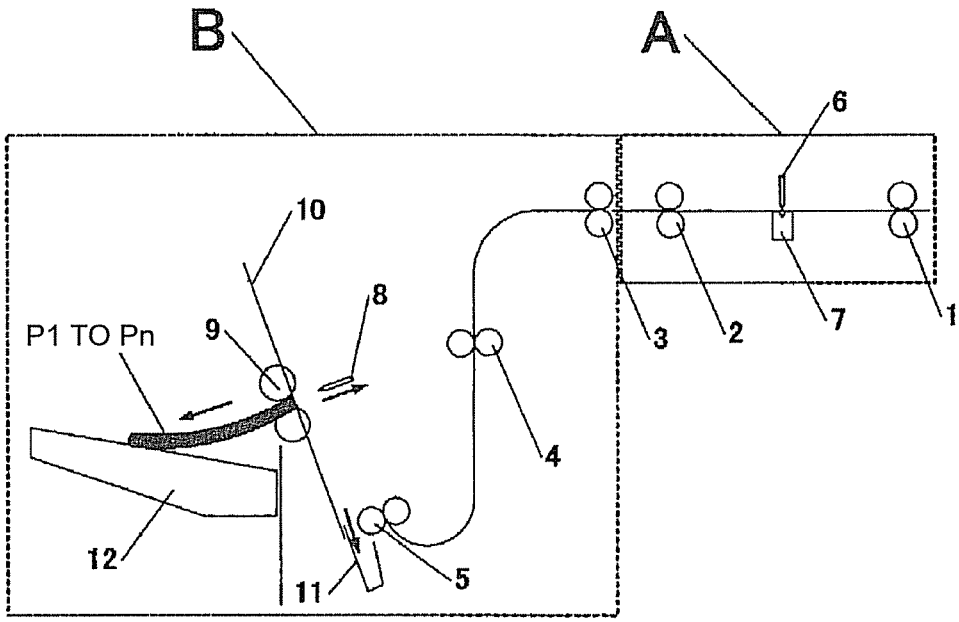
FIG. 12 is an operation explanatory diagram that illustrates a state where a center-folding process has been performed by the pair of folding rollers and the sheets are being discharged.
Figure 13:
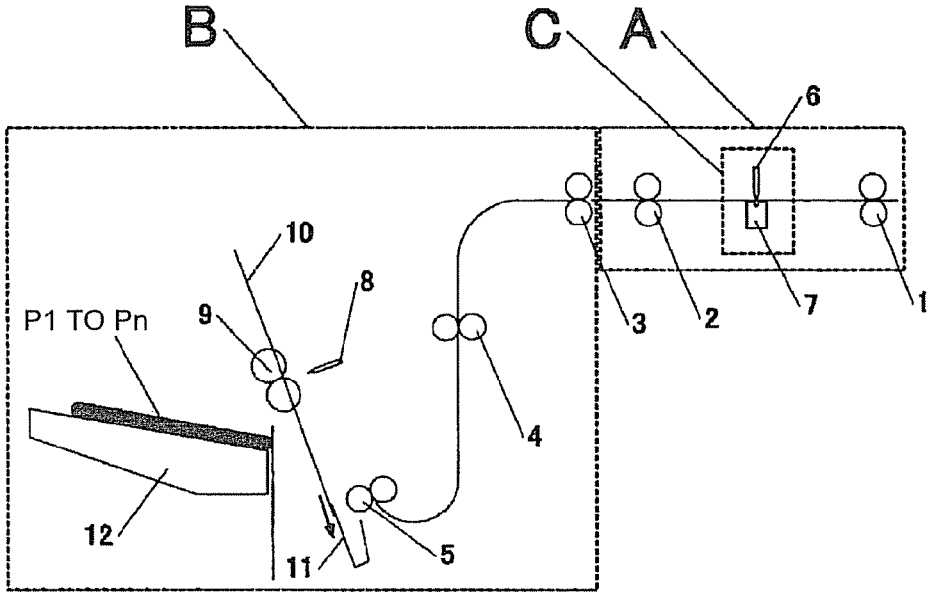
FIG. 13 is an operation explanatory diagram that illustrates a state after the center-folding process is performed and the sheets are discharged to a discharge tray.

Afterward, the sheet P1 on which the crease has been formed is conveyed to the folding processing apparatus B (FIG. 6) and temporarily stored in the center-folding processing tray 10 (FIG. 7). The above operation is repeated for a predetermined number of sheets (FIG. 8). If a pile of a predetermined number of sheets P1 to Pn is stored (FIG. 9), the pile of sheets is lifted up to a folding position by the trailing-edge fence 11 so as to set the folding position (FIG. 10). Then, the folding plate 8 is moved forward to push against the crease area formed on the sheet and is pushed into the nip of the pair of folding rollers 9, whereby the folding process is performed (FIG. 11). The pile of sheets is then discharged into the stacking tray 12 (FIGS. 12 and 13). This process for creating one booklet from a pile of sheets is repeated for a predetermined number of booklets, and the booklets are sequentially stacked in the stacking tray 12.

Figure 14:
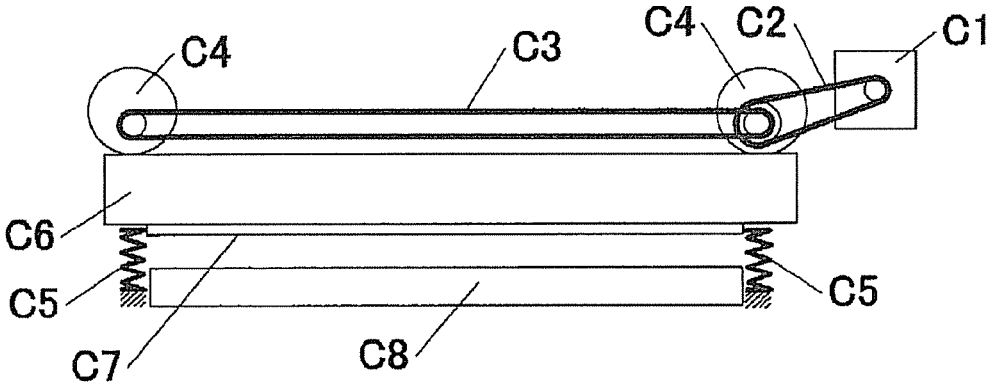
FIG. 14 is a diagram that illustrates a schematic configuration of a creasing mechanism and illustrates a state where a creasing blade is located away from a receiving board.
Figure 15:
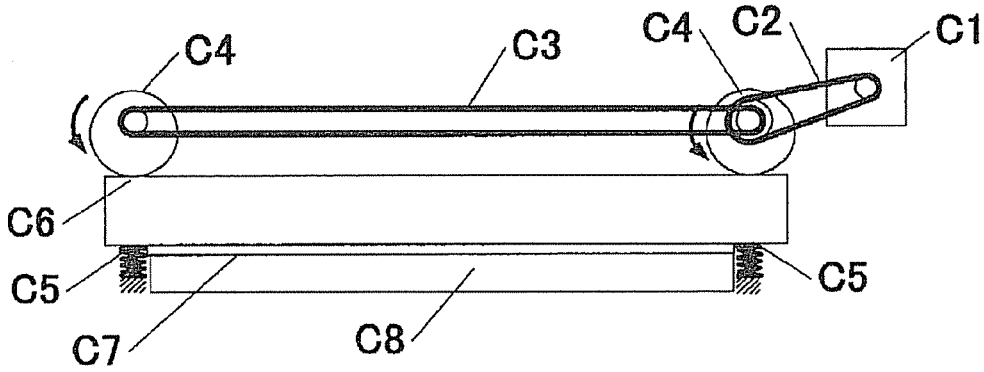
FIG. 15 is a diagram that illustrates a schematic configuration of the creasing mechanism and illustrates a state where the creasing blade is pressed against the receiving board to form a crease.

FIGS. 14 and 15 are diagrams that illustrate a schematic configuration of a creasing mechanism. As illustrated in FIGS. 14 and 15, the creasing member 6 of the creasing mechanism C includes a creasing blade C7 and a mounting stage C6. The creasing blade C7 and the mounting stage C6 are provided as a unit and the unit is elastically biased upward by an elastic member C5 so that the top surface of the mounting stage C6 is in contact with cams C4. The cams C4 are arranged as a pair. A driving force of a drive motor C1 is transmitted to the cams C4 via a reduction transmission mechanism C2 and a transmission mechanism C3 so that the cams C4 are rotated. Each of the cams C4 is an eccentric cam, and the cams C4 are rotated in synchronization with each other so that the creasing blade C7 together with the mounting stage C6 is moved upward and downward.

Figure 16:
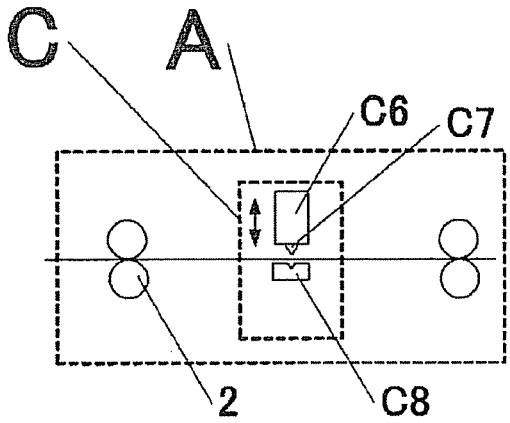
FIG. 16 is a schematic view as seen from a front side of FIG. 14.

A receiving board C8 is located at the position facing the creasing blade C7. A sheet is sandwiched between the creasing blade C7 and the receiving board C8 so that a crease is formed on the sheet. In FIG. 14, the creasing blade C7 is located in the highest position that corresponds to a position for receiving a sheet. In FIG. 15, the creasing blade C7 is located at the lowest position that corresponds to a position for forming a crease on a sheet. FIG. 16 is a schematic view as seen from a front side of FIG. 14. The sheet is held in a nip of a first conveying unit 1 during the creasing operation illustrated in FIG. 5; however, if a force in the direction of forward movement is applied to the sheet in accordance with the downward movement of the creasing blade C7, movement of the sheet in the direction of forward movement is allowed due to an operation of a not depicted one-way clutch that is located in a shaft of the first conveying unit 1.

These are the configuration and operation of the system that includes the creasing apparatus A and the folding processing apparatus B, based on which the present invention is described.

Figure 17:
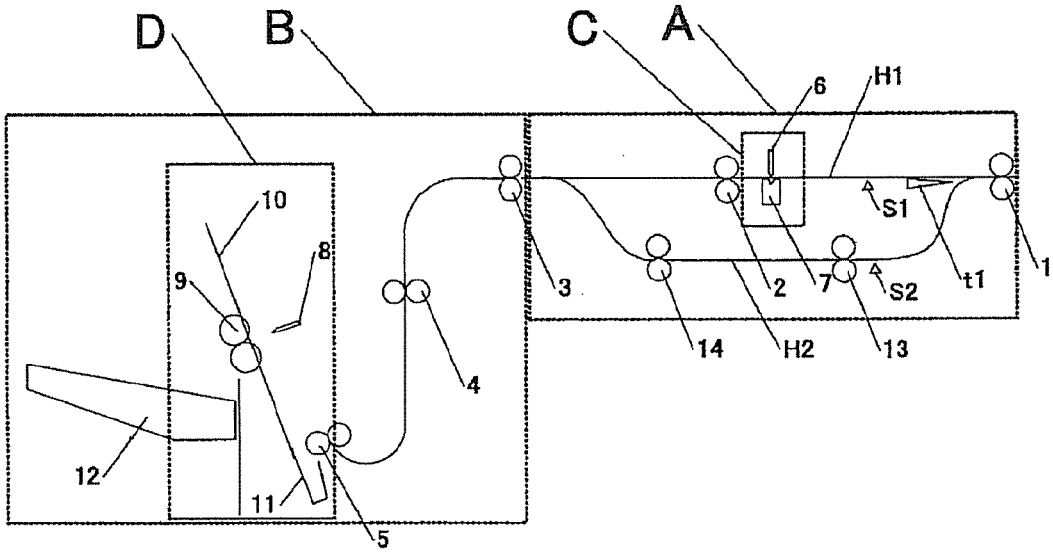
FIG. 17 is a diagram that illustrates a schematic configuration of an image forming system according to a first example.
Figure 18:
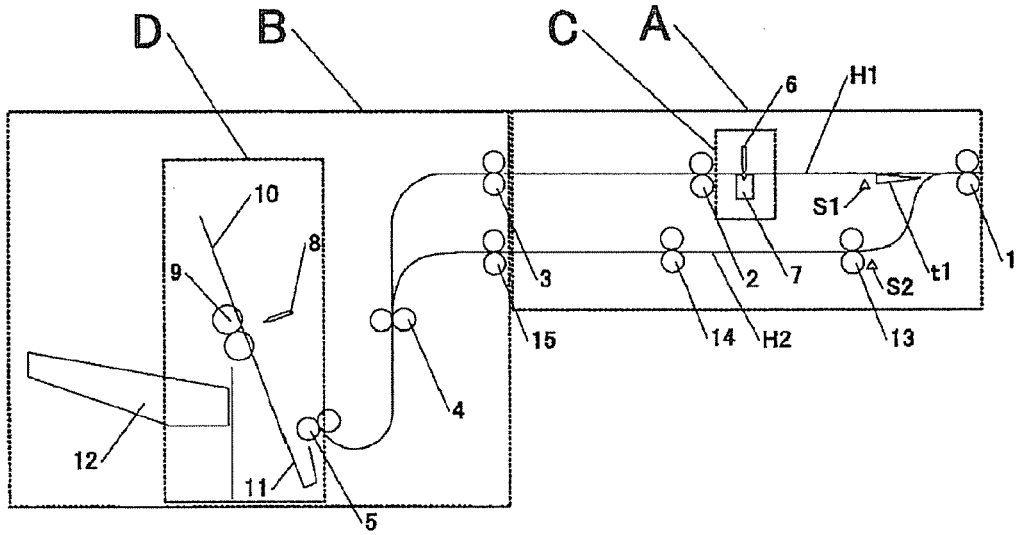
FIG. 18 is a diagram that illustrates a schematic configuration of a modified example of the image forming system according to the first example.

FIGS. 17 and 18 are diagrams that illustrate a schematic configuration of the image forming system according to a first example. In the first example, a branching claw is arranged as a branching unit t1 on a conveying path (hereafter, referred to as the first conveying path H1) of the creasing apparatus A of the above-described system. The branching unit t1 is located on the upstream side, in the sheet conveying direction, of the creasing mechanism C that includes the creasing member 6 and the receiving board 7 near the first conveying unit 1. The branching unit t1 enables a sheet to be conveyed to the second conveying path H2 without passing through the creasing mechanism. The branching claw is driven by, for example, a solenoid.

Sixth and seventh conveying units 13 and 14 are located on the second conveying path H2 apart from each other at a predetermined distance so that a sheet can be conveyed therebetween. The most extreme downstream side of the second conveying path H2 is connected to and joined together with the first conveying path H1 on the downstream side of the creasing mechanism C in the creasing apparatus A (FIG. 17), or the most extreme downstream side of the second conveying path H2 is connected to and joined together with the upstream side of the fourth conveying unit 4 in the folding processing apparatus B (FIG. 18). The reference numeral 15 denotes an eighth conveying unit that is located on a conveying path connected to the second conveying path H2 in the folding processing apparatus B.

First and second detecting units S1 and S2 that detect sheets are located on the first and the second conveying paths H1 and H2, respectively. For example, light reflective sensors are used as the detecting units S1 and S2. The first detecting unit S1 is located between the branching unit t1 and the creasing mechanism C, and the second detecting unit S2 is located between the first conveying unit 1 and the sixth conveying unit 13.

Figure 19:
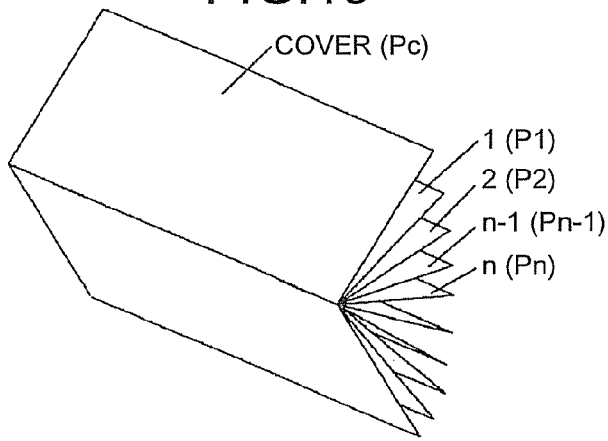
FIG. 19 is an explanatory diagram that illustrates a structure of a booklet.

As illustrated in FIG. 19, when a booklet including a sheet Pc that is a cover and sheets P1 to Pn that are inner sheets is created by a post-processing apparatus, if the cover Pc is relatively thick with respect to the inner sheets P1 to Pn, a creasing process may be performed on the cover Pc before a folding process so that a clear folding line is formed on the cover Pc, and the creasing process may not be performed on the inner sheets P1 to Pn. In such a case, because the creasing process requires a certain period of time, if the creasing process is first performed on the cover Pc, then the inner sheets P1 to Pn are conveyed, and a center-binding process and a center-folding process are performed after everything is put all together, it reduces productivity because of the time it takes to perform the creasing process.

In such a case, there is a method according to the present example in which, when a crease is being formed on the cover Pc, the subsequent sheet is stopped on the second conveying path H2 and, when the creasing for the cover Pc has been completed, the cover Pc is conveyed and then the subsequent sheet is conveyed to the folding processing apparatus B next to the cover Pc. After the subsequent sheet, another subsequent sheet is conveyed through the first conveying path H1 so that all of the inner sheets P1 to Pn are sequentially conveyed.

Thus, if the creasing process is completed while one subsequent sheet is being stopped, the creasing process and the center-folding process can be performed within the same time period as the case where the creasing process is not performed.

If the creasing process takes a long time and/or if an interval of sheets to be conveyed from the image forming apparatus is short (if the image forming apparatus has high productivity), there is a possibility that not only a subsequent sheet immediately subsequent to the cover but also sheet(s) following the subsequent sheet are conveyed before the creasing process for the cover is completed. A' second example describes an example of a configuration that can be applied to the above case.

Figure 20:
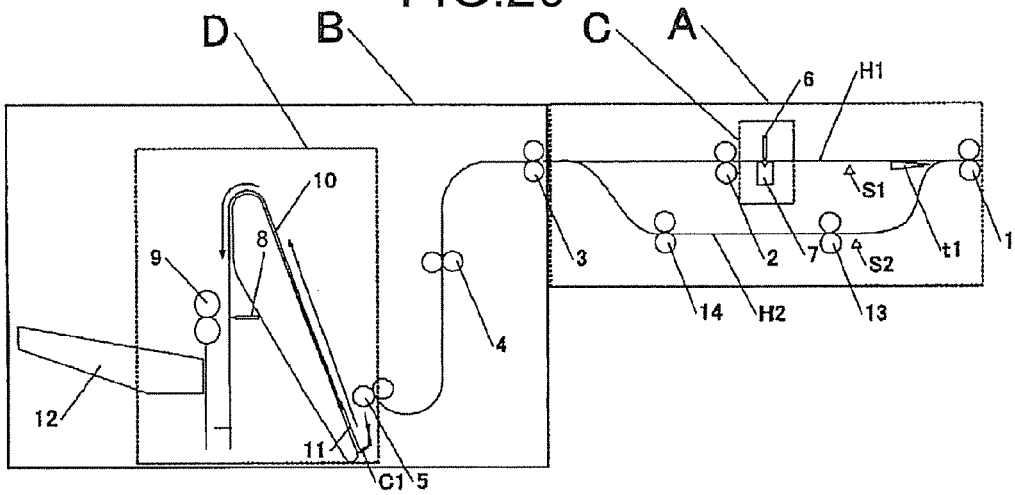
FIG. 20 is a diagram that illustrates a schematic configuration of an image forming system according to a second example.

FIG. 20 is a diagram that illustrates a schematic configuration of an image forming system according to the second example. As illustrated in FIG. 20, the second example has a configuration such that the folding processing apparatus B, which is connected to the downstream side of a creasing apparatus A, includes the processing tray 10 (center-folding processing tray 10) that temporarily stores a pile of sheets for a booklet before a folding process is performed; and a center-folding unit that including the folding roller 9 and the folding plate 8 that are located downstream of the processing tray 10. A pile of sheets is conveyed from the processing tray 10 to the center-folding unit by a conveying unit C1.

In the second example, the conveying unit C1 includes, for example, a release belt and a trailing-edge fence. The trailing edge of a sheet is aligned one by one by the trailing-edge fence, a sheet is aligned in the direction (the sheet width direction) perpendicular to the conveying direction by a not depicted jogger fence, and then a pile of sheets, for which a folding process is to be performed, is temporarily stored in the processing tray 10. Afterward, the pile of sheets is lifted up together with the trailing-edge fence. Thus, the pile of sheets is turned over along the curved conveying path that is located above, and the position of the leading edge of the pile of sheets is determined such that the center section of the pile in the sheet conveying direction is facing the folding plate 8. Then, the folding plate 8 is pushed into the nip of the pair of folding rollers 9 at that position so that a twofold booklet is created. To lift up a pile of sheets, a not depicted release claw that is fixed to the release belt can be used instead of the trailing-edge fence.

Figure 21:
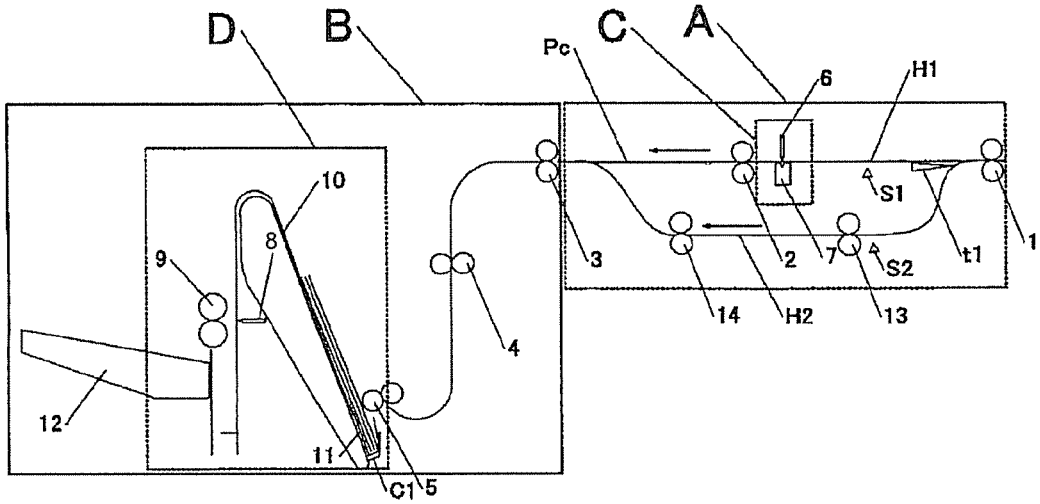
FIG. 21 is an operation explanatory diagram that illustrates a state where a inner sheets of the booklet are previously stored in a processing tray and a last cover is conveyed downstream after a crease is formed thereon.

With the configuration of the second example, after a pile of sheets which is to be a booklet is temporarily stored in the processing tray 10, the pile of sheets is turned over and conveyed to a folding processing unit and the pile of sheets is pushed into the nip of the folding rollers 9 by the folding plate 8 so that a booklet is created; therefore, as illustrated in FIG. 21, the inner sheets Pn to P1 are first stored in the processing tray 10 and finally the cover Pc is stored in the processing tray 10. Because the cover Pc needs to be conveyed last of all, the cover Pc is first conveyed to the creasing apparatus A and, while the creasing process is being performed, the inner sheets Pn to P1 are sequentially conveyed downstream to the folding processing apparatus B and, after all of the inner sheets Pn to P1 have been conveyed and the creasing process for the cover Pc has completed, the cover Pc is conveyed downstream to the folding processing apparatus B; thus, even if the creasing process requires a certain period of time, any decrease in productivity can be kept to a minimum.

Figure 22:
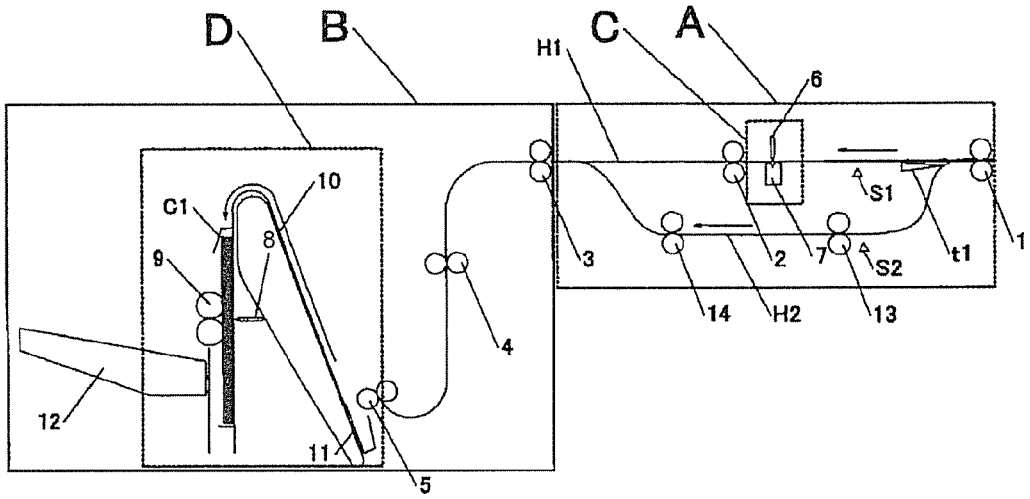
FIG. 22 is an operation explanatory diagram that illustrates a state where a pile of sheets for a first booklet is just about to be subjected to the folding process and a cover of a second booklet is conveyed to the creasing apparatus.

FIG. 22 illustrates a state just before the folding process is performed on a pile of sheets for one job to create a first booklet and a state when the cover Pc is conveyed to the creasing apparatus A for a subsequent job to create a second booklet.

Figure 23:
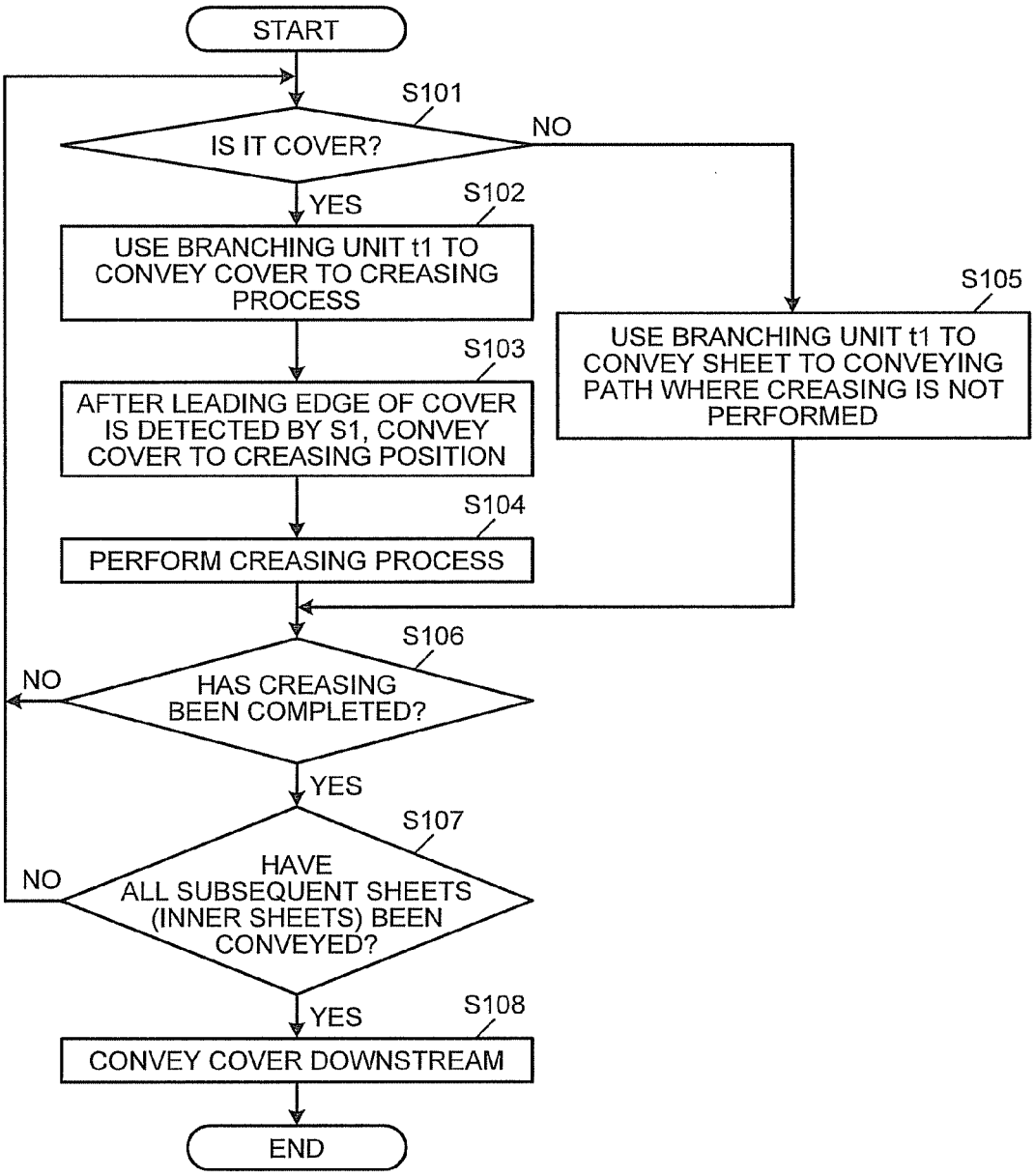
FIG. 23 is a flowchart that illustrates a procedure according to the second example.

FIG. 23 is a flowchart that illustrates a procedure of the creasing apparatus at that time.

In this procedure, a check is made as to whether the conveyed sheet is a cover or not (Step S101). If it is a cover, the cover (sheet) Pc is guided to the first conveying path H1 by the branching unit t1 and conveyed to the creasing mechanism C (Step S102). After the leading edge of the cover Pc is detected by the first detecting unit S1, the cover Pc is conveyed to the creasing position (Step S103) so that the creasing process is performed at the creasing position (Step S104). Conversely, if the sheet is not a cover, i.e., if the sheet is an inner sheet (No at Step S101), the first branching unit t1 switches the conveying path to the second conveying path H2 where the creasing is not performed, and the sheet is conveyed to the second conveying path H2 (Step S105). Then, a check is made as to whether the creasing has been completed (Step S106) or not, and, if the creasing has not been completed, the process from Steps S101 to S105 is repeated until the creasing for one booklet (one job) has been completed.

When the creasing has been completed at Step S106, a check is made as to whether or not all subsequent sheets (the inner sheets P1 to Pn) have been conveyed to the processing tray 10 (Step S107). Until all subsequent sheets have been conveyed, the process after Step S101 is repeated. When all subsequent sheets have been conveyed (Yes at Step S107), the cover Pc is conveyed to the processing tray 10 (Step S108).

Figure 24:
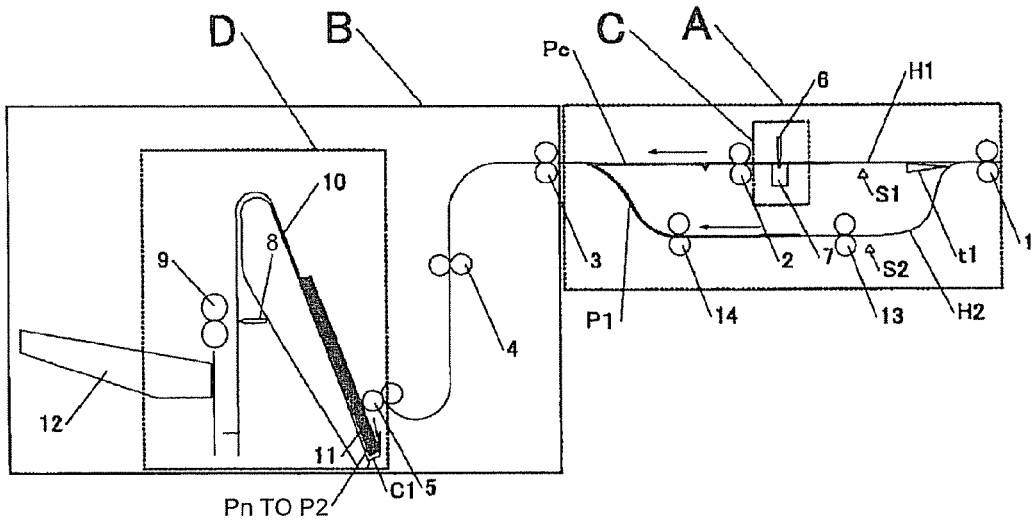
FIG. 24 is an operation explanatory diagram that illustrates a state where the inner sheets are stored in the processing tray and a sheet before the last sheet and the last cover with a crease formed thereon are conveyed in a stacked manner according to the second example.

As illustrated in FIG. 24, when the last sheet P1 of the inner sheets is conveyed downstream to the folding processing apparatus B, the sheet P1 is conveyed together with the cover Pc for which the creasing process has been completed in a stacked manner so that the cover Pc does not need to wait until the last inner sheet P1 has completely passed through the first conveying path H1 (the second conveying path H2); thus, any decrease in the productivity can be reduced or productivity can be maintained.

Figure 25:
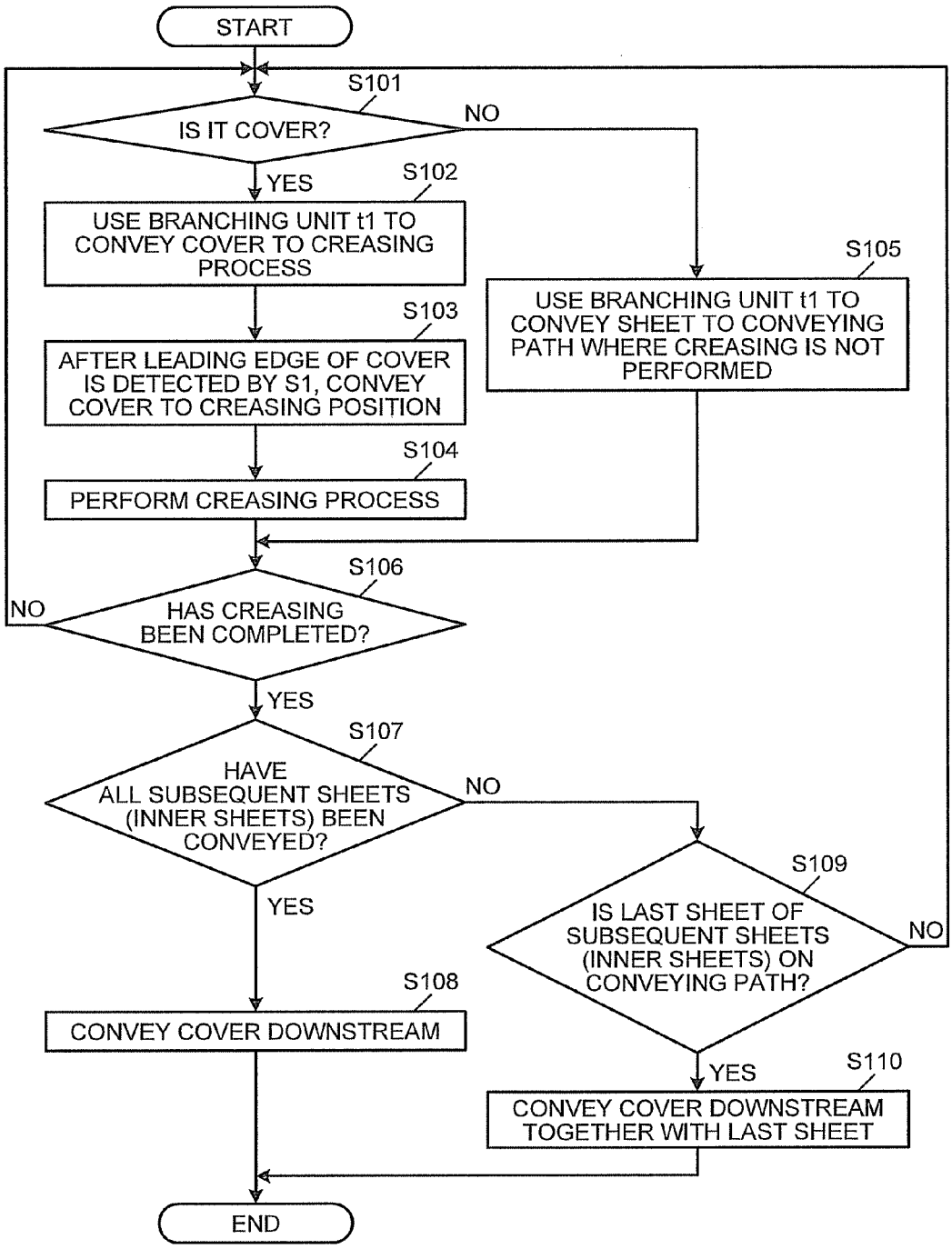
FIG. 25 is a flowchart that illustrates a procedure of the operation illustrated in FIG. 24.

FIG. 25 is a flowchart that illustrates a procedure in a case where the last inner sheet P1 and the cover Pc are conveyed in a stacked manner, as illustrated in FIG. 24.

In the procedure illustrated in FIG. 23, if all of the subsequent sheets have not been conveyed at Step S107, the process returns to Step S101 and the subsequent steps are repeated. Conversely, in the procedure illustrated in FIG. 25, if all of the subsequent sheets have not been conveyed at Step S107, a check is made as to whether or not the last sheet P1 of the subsequent sheets (the inner sheets P1 to Pn) has been conveyed to the second conveying path H2 (Step S109). If the last sheet P1 has not been conveyed to the second conveying path H2, the process returns to Step S101 and the subsequent steps are repeated. If the last sheet P1 has been conveyed to the second conveying path H2 (Yes at Step S109), the last sheet P1 is conveyed to the processing tray 10 together with the cover Pc on which the creasing process is performed on the first conveying path H1, in a stacked manner (Step S110).

Figure 26:
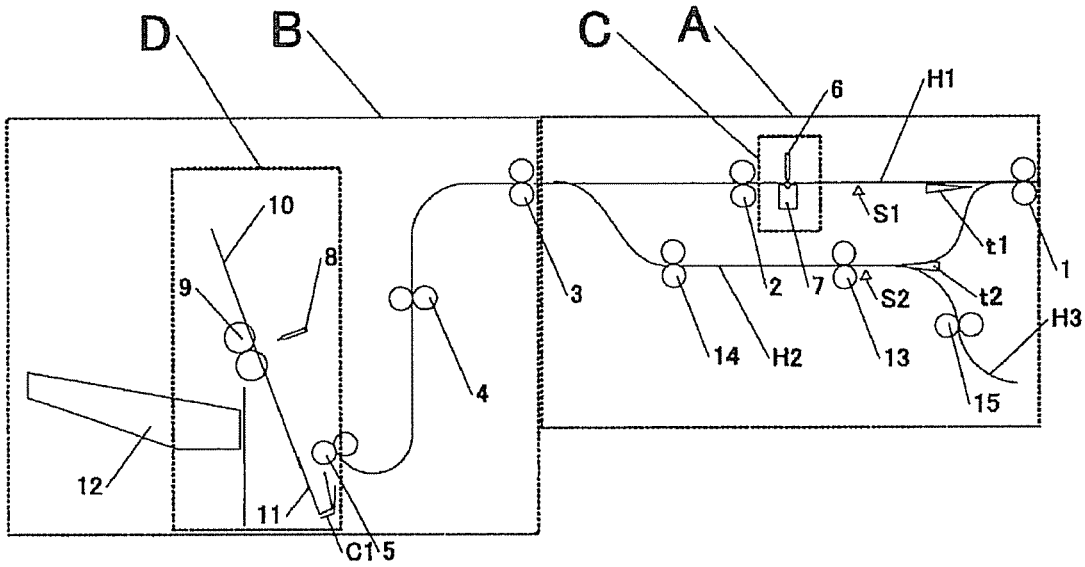
FIG. 26 is a diagram that illustrates a schematic configuration of an image forming system according to a third example.

FIG. 26 is a diagram that illustrates a schematic configuration of an image forming system according to a third example. In the present example, if a folding processing apparatus has the same configuration as that in the first example, a sheet waits in a creasing apparatus A.

In the present example, the second conveying path H2 of the first example is further connected to the third conveying path H3, and a sheet conveyed to the second conveying path H2 is fed backward to the upstream side in the sheet conveying direction so as to wait on the third conveying path H3. A second branching unit t2 is located at a branch point between the second conveying path H2 and the third conveying path H3 so as to control the conveying of a sheet to the third conveying path H3. The other units have the same configuration as those in the first example.

Figure 27:
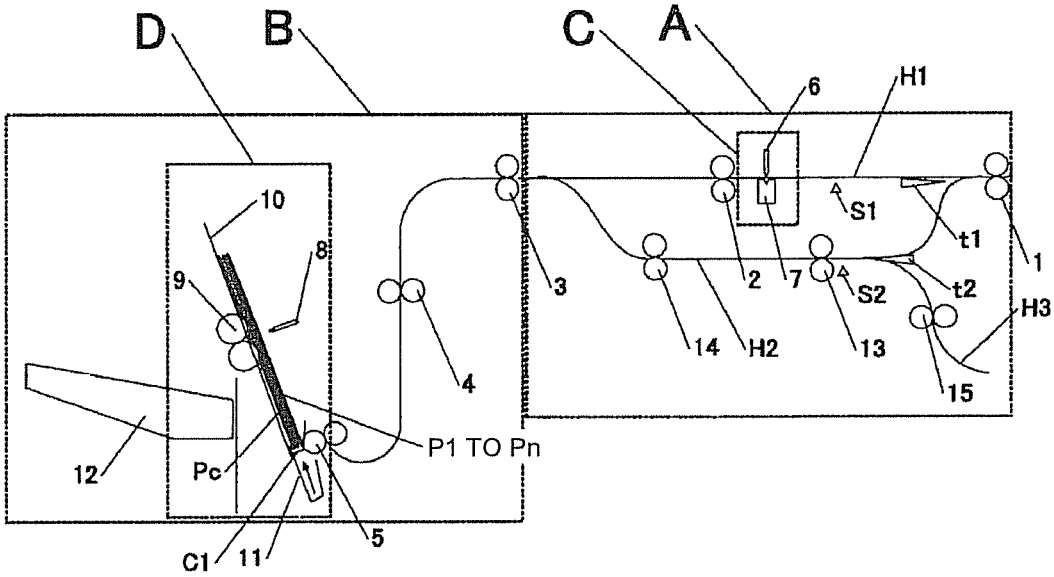
FIG. 27 is an operation explanatory diagram that illustrates an operation performed when a sheets for a booklet are accumulated in a processing tray and then lifted up to a center-folding position so as to be folded at the center section thereof.

In the above-described configuration, if a pile of sheets which is to be a booklet is stored in the processing tray 10 as illustrated in FIG. 27, lifted up to a predetermined position by the conveying unit C1, and then pushed into the nip of the pair of folding rollers 9 by the folding plate 8 so as to create a booklet, it is necessary to first store the cover Pc in the processing tray 10 and then store the inner sheets P1 to Pn. While the creasing process is being performed on the initially received cover Pc in the creasing apparatus A, the conveyed subsequent inner sheets P1 to Pn are temporarily stored on the second conveying path H2 (third conveying path H3) where the creasing process is not performed and, after the creasing process for the cover Pc has been completed, the cover Pc is conveyed downstream to the folding processing apparatus B and then the complete pile of temporarily stored inner sheets P1 to Pn is conveyed downstream to the folding processing apparatus B; thus, even if the creasing process requires a certain period of time, any decrease in productivity can be kept to a minimum.

Figure 28:
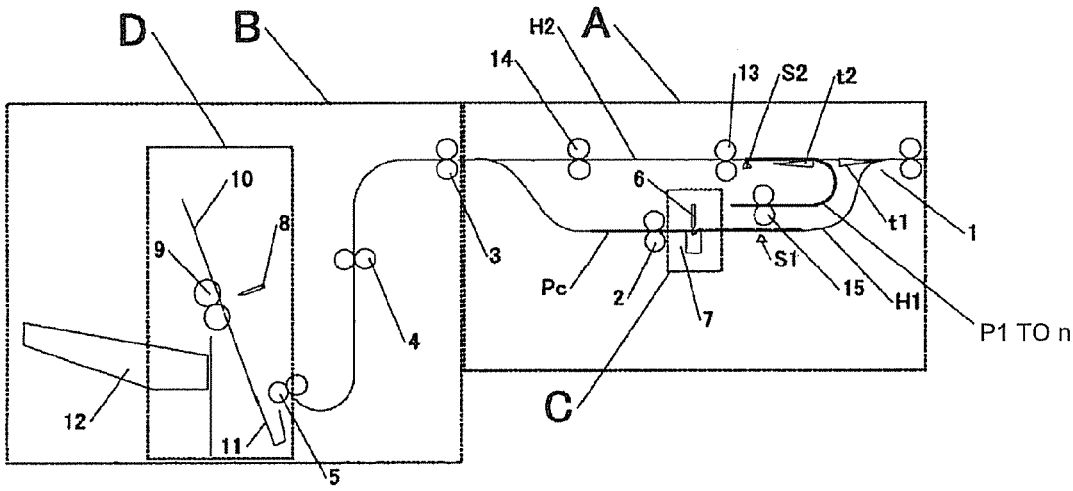
FIG. 28 is a diagram that illustrates a schematic configuration of a modified example where the positional relation of a first conveying path and a second conveying path illustrated in FIG. 26 is inverted.

Furthermore, the positions of the first conveying path H1 and the second conveying path H2 as illustrated in FIG. 26 can be changed as illustrated in FIG. 28 so that the first conveying path H1 is located on the lower side and the second conveying path H2 is located on the upper side. In this case, the third conveying path H3 is located on the lower side of the branch point of the second conveying path H2, and the second branching unit t2 is located at the branch point. The creasing mechanism C is located on the first conveying path H1 that is positioned on the lower side. Specifically, if the positional relation of the first conveying path H1 and the second conveying path H2 is inverted in the creasing apparatus A illustrated in FIG. 26 and the creasing apparatus A illustrated in FIG. 28, when the pile of inner sheets P1 to Pn, which have been conveyed in the order from P1 to Pn and then temporarily stored, is conveyed downstream to the folding processing apparatus B, the pile of inner sheets P1 to Pn is conveyed together with the cover Pc for which the creasing process has been completed, in a stacked manner so that the pile of inner sheets P1 to Pn do not need to wait until the cover Pc has completely passed through; thus, any decrease in the productivity can be reduced or the productivity can be maintained.

Figure 30:
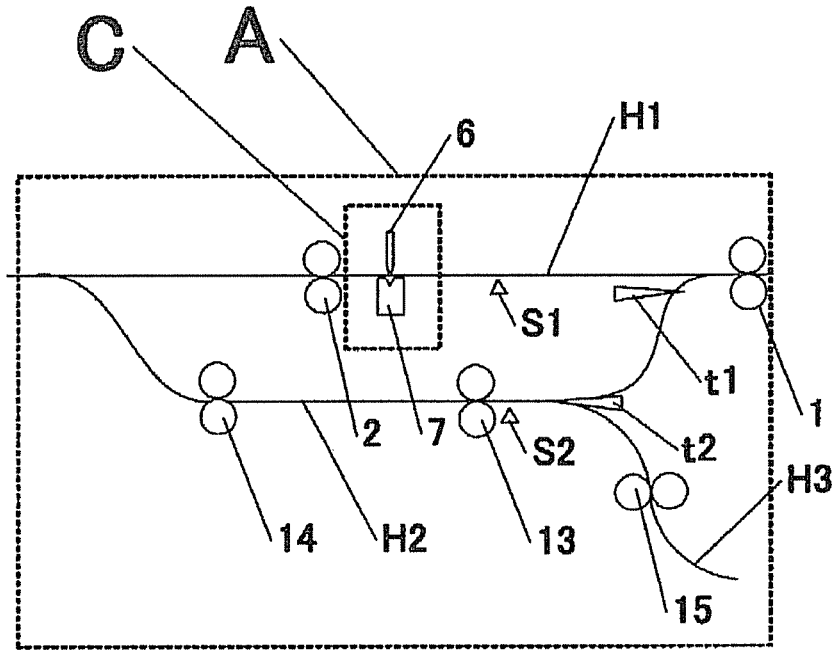
FIG. 30 is a diagram that illustrates a schematic configuration of a creasing apparatus of an image forming system according to a fourth example.

If the downstream folding processing apparatus B has the configuration as illustrated in FIG. 20, i.e., it includes the processing tray 10 that temporarily stores a pile of sheets for a booklet before the folding process is performed and it includes the center-folding unit including the folding roller 9 and the folding plate 8 that are located downstream of the processing tray 10 so that a pile of sheets is conveyed to the center-folding unit from the processing tray 10 by the conveying unit C1, and if the creasing apparatus A has the configuration as illustrated in FIG. 30, the pile of inner sheets P1 to Pn which have been conveyed in the order from P1 to Pn and then temporarily stored, and the cover Pc for which the creasing process has been completed, are conveyed downstream in a stacked manner, which results in an advantage in the productivity.

Furthermore, after the cover Pc has been conveyed downstream to the folding processing apparatus B, temporarily storing the inner sheets P1 to Pn is continued, and when the last sheet Pn is conveyed, the last sheet Pn is conveyed together with the pile of inner sheets P1 to Pn−1 including the previous sheet to the last sheet so that the pile of inner sheets P1 to Pn is conveyed downstream to the folding processing apparatus B, which also can reduce any decrease in the productivity or maintain the productivity. At that time, the last sheet Pn may be put together with the pile of temporarily stored inner sheets on the conveying path where the creasing process is not performed, or the last sheet Pn may be conveyed to the conveying path where the creasing process is performed, further conveyed without the creasing process being performed, and then put together with the pile of temporarily stored inner sheets downstream on the second conveying path H2 or third conveying path H3 where the creasing process is not performed.

Figure 29:
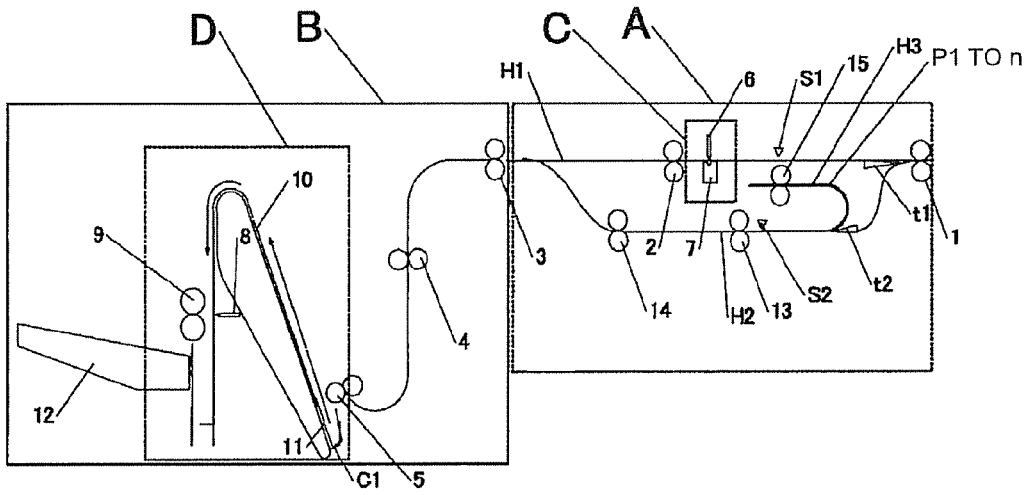
FIG. 29 is a diagram that illustrates a schematic configuration of a modified example where a third conveying path is located on a side of the second conveying path illustrated in FIG. 26, the side is a side closer to the first conveying path.

If the downstream folding processing apparatus B has the configuration as illustrated in FIG. 20, i.e., it includes the processing tray 10 that temporarily stores a pile of sheets for a booklet before the folding process is performed and it includes the center-folding unit including the folding roller 9 and the folding plate 8 that are located downstream of the processing tray 10 so that a pile of sheets is conveyed to the center-folding unit from the processing tray 10 by the conveying unit C1, and if the creasing apparatus A has a configuration as illustrated in FIG. 29, the sheets conveyed in the order from P1 to Pn are temporarily stored and the pile of inner sheets P1 to Pn is conveyed downstream together with the cover Pc for which the creasing process has been completed, in a stacked manner, which results in an advantage in the productivity.

FIG. 30 is a diagram that illustrates a schematic configuration of an image forming system according to a fourth example. In the present example, the configuration of the folding processing apparatus B is the same as that of the second example, the configuration of the creasing apparatus A is the same as that of the third example, and the pile of inner sheets P1 to Pn is temporarily stored in the creasing apparatus A.

As illustrated in FIG. 30, a conveying path used for temporarily storing sheets is arranged as the third conveying path H3 on the second conveying path H2 where the creasing process is not performed, and the second branching unit t2 is located at the branch point between the second conveying path H2 and the third conveying path H3. The branching unit t1 located at the branch point between the first conveying path H1 and the second conveying path H2 is hereafter referred to as the first branching unit t1 so as to be clearly distinguished from the second branching unit t2. The conveying unit 15 is located on the third conveying path H3, and the conveying unit 15 may have a function of conveying a sheet on the third conveying path H3 (the same as the example illustrated in FIG. 28). The first and the second branching units t1 and t2 are driven by a drive source such as a solenoid or motor. The second branching unit t2 may be always elastically biased by an elastic member such as a spring and the second branching unit t2 may be biased as a default, so that a sheet is always guided to one conveying path. The second branching unit t2 does not have a drive source and, as illustrated in Figure, the swinging end of the second branching unit t2 is always pulled to the upper side so that a sheet can be guided to the third conveying path H3. Thus, when a sheet is conveyed from the first conveying path H1, the sheet is conveyed to the second conveying path H2, and after the trailing edge of the sheet passes through the second branching unit t2, the sheet is fed backward to the upstream side in the sheet conveying direction so that the sheet is automatically conveyed to the third conveying path H3.

Figure 31:
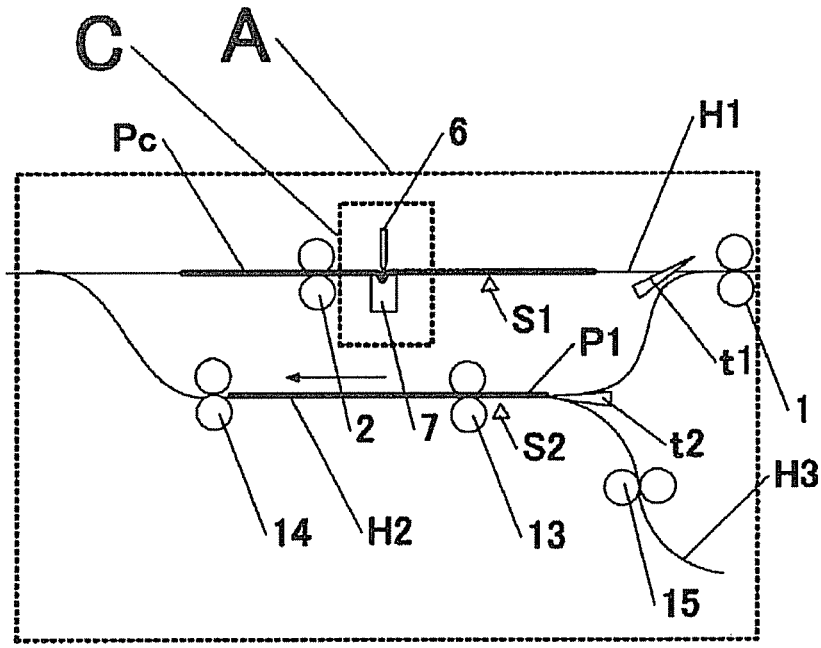
FIG. 31 is an operation explanatory diagram that illustrates a state where, while a creasing process is being performed on a cover on a first conveying path, a subsequent sheet is conveyed to a second conveying path.
Figure 32:
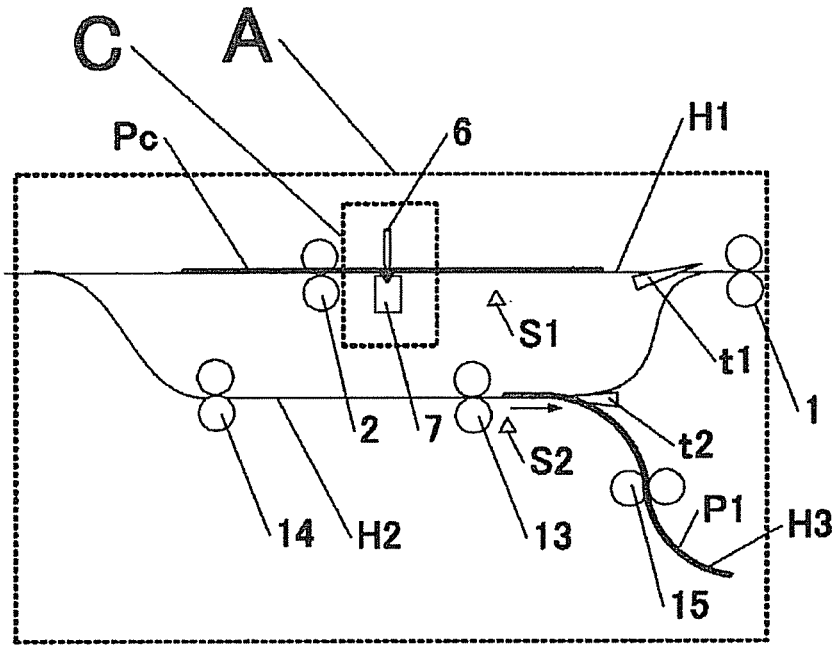
FIG. 32 is a diagram that illustrates a state where, while the creasing process is being performed on the cover on the first conveying path, the subsequent sheet is conveyed in the opposite direction and conveyed from the second conveying path to a third conveying path so that the subsequent sheet is in a stand-by state.

FIGS. 31 and 32 are operation explanatory diagrams that illustrate operations performed in the third example.

As illustrated in FIG. 31, while the creasing process is being performed on the cover Pc on the first conveying path H1, the subsequent sheet P1 is conveyed. The sheet P1 and subsequent sheets are conveyed to the second conveying path H2 by the first branching unit t1. The sheet P1 and subsequent sheets are further conveyed while the leading edge of each sheet pushes down the second branching unit t2 that is always pulled to the upper side. When the second detecting unit S2 located on the second conveying path H2 detects the trailing edge of the conveyed sheet P1, the sixth and seventh conveying units 13 and 14 are rotated backward so that the sheet P1 is conveyed in the opposite direction. Because the second branching unit t2 is always elastically biased to the upper side and the third conveying path H3 is open, the trailing edge of the sheet is conveyed to the third conveying path H3. As illustrated in FIG. 32, when the temporarily stored sheet P1 is taken by the nip of the eighth conveying unit 15 and the leading edge of the sheet passes through the nip of the sixth conveying unit 13 and is detected by the second detecting unit S2, the sheet is conveyed for a predetermined distance from that position and stopped at the stand-by position so as to wait for the subsequent sheet P2.

Figure 33:
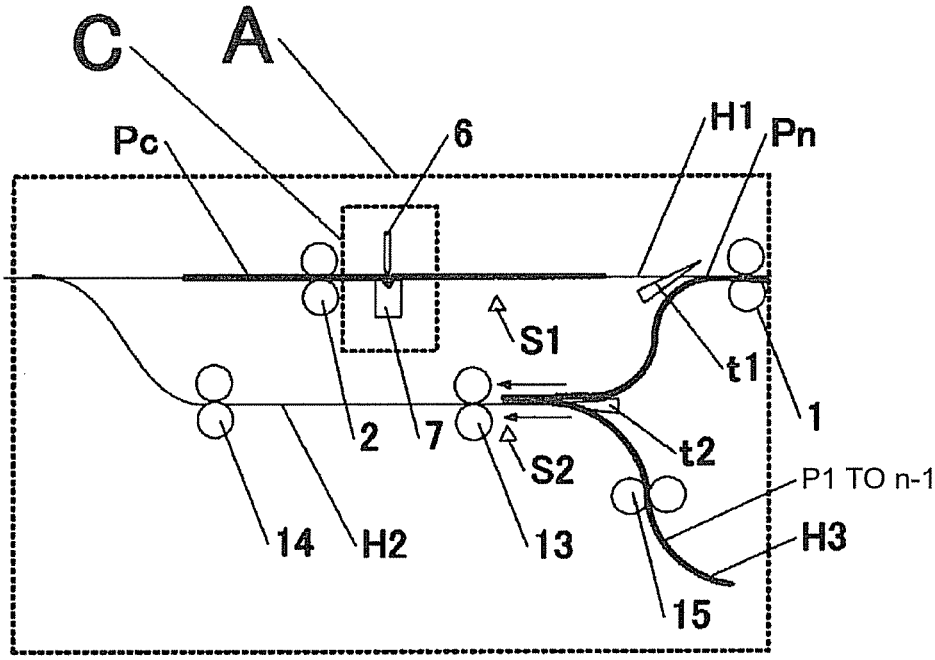
FIG. 33 is an operation explanatory diagram that illustrates a state where, when another subsequent sheet is conveyed to the second conveying path in the state illustrated in FIG. 32, a leading edge of another subsequent sheet is overlapped with a leading edge of the subsequent sheet that is in a stand-by state on the third conveying path, and the subsequent sheets are conveyed downstream.
Figure 34:
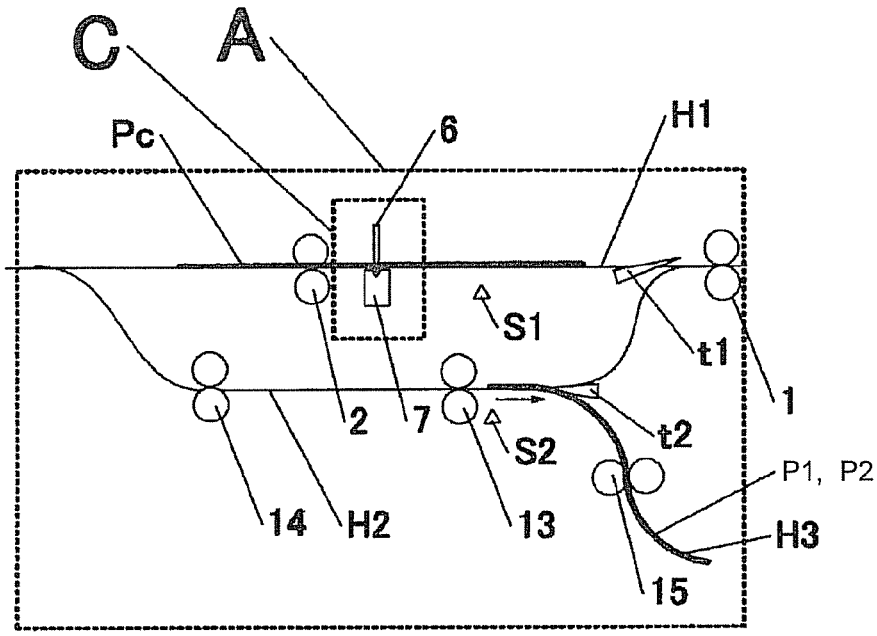
FIG. 34 is an operation explanatory diagram that illustrates an operation where, after the sheets in the state illustrated in FIG. 33 are conveyed downstream until the trailing edges of the sheets pass through a second detecting unit, the sheets are conveyed in the opposite direction and held in a stand-by state on the third conveying path in a stacked manner.

When the subsequent sheet P2 is conveyed to be temporarily stored, the previous sheet P1 which has been already stored is conveyed by the eighth conveying unit 15 such that the leading edge of the previous sheet P1 is stacked together with the leading edge of the subsequent sheet P2, as illustrated in FIG. 33, and the previous sheet P1 and the subsequent sheet P2 are conveyed in a stacked manner. When the second detecting unit S2 detects the trailing edges of both the sheets, the sixth and seventh conveying units 13 and 14 are rotated backward so as to convey the sheets in the opposite direction. Thus, the two stacked sheets are guided to the opened third conveying path H3 by the second branching unit t2. As illustrated in FIG. 34, when the two temporarily stored sheets P1 and P2 are taken by the nip of the eighth conveying unit 15 and the leading edges of the two sheets pass through the nip of the sixth conveying unit 13 and are detected by the second detecting unit S2, the sheets are conveyed for a predetermined distance from that position and stopped at the stand-by position so as to wait for the subsequent sheet P3.

Figure 35:
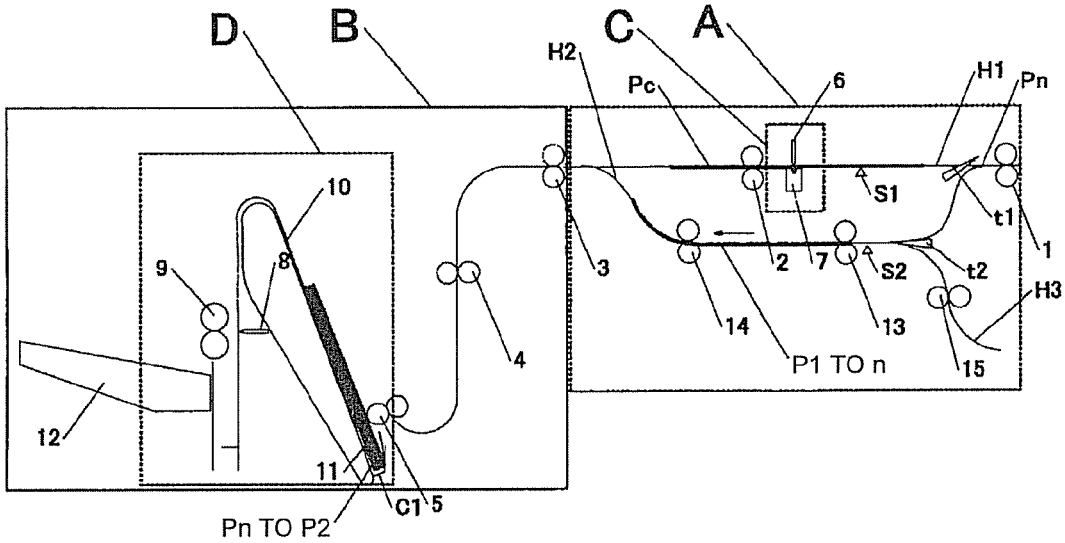
FIG. 35 is an operation explanatory diagram that illustrates a state where a sheets including a sheet before a last sheet are stored in a processing tray and the last sheet is conveyed to the processing tray together with the first cover with a crease formed thereon.

The operations illustrated in FIGS. 31 to 34 are repeated for a predetermined number of sheets so that the inner sheets P1 to Pn can be temporarily stored in the creasing apparatus A. After the creasing process for the cover Pc has been completed, the pile of temporarily stored inner sheets P1 to Pn is conveyed downstream as illustrated in FIG. 35, and the center-folding process is performed as illustrated in FIG. 24.

Figure 36:
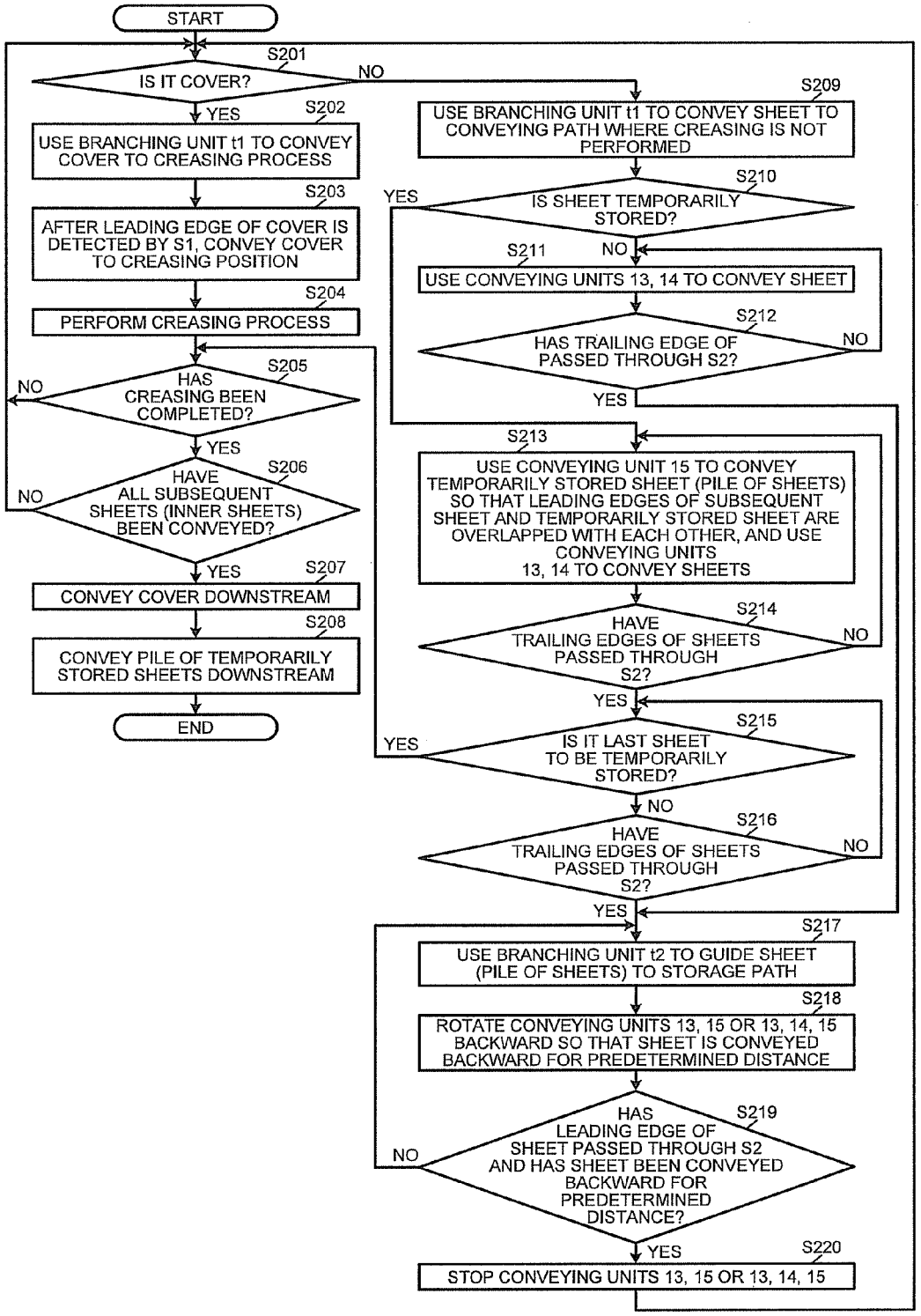
FIG. 36 is a flowchart that illustrates a procedure according to the fourth example.

FIG. 36 is a flowchart that illustrates a procedure performed at that time.

As illustrated in FIG. 36, when the process starts, a check is first made as to whether the conveyed sheet is the cover Pc or not (Step S201). If it is the cover Pc, the branching unit t1 is switched to the side of the first conveying path H1 so that the cover Pc is guided to the first conveying path H1 (Step S202). Then, when the leading edge of the cover Pc is detected by the first detecting unit S1, the cover Pc is conveyed to the creasing position in accordance with the detection position timing (Step S203). When the cover Pc is stopped at the creasing position, the creasing mechanism C performs the creasing process (Step S204), and then the process proceeds to Step S205.

Conversely, if it is not the cover Pc (No at Step S201), in other words, if it is one of the inner sheets P1 to Pn, the branching unit t1 is switched to the side of the second conveying path H2 where the creasing process is not performed so that the inner sheet is guided to the second conveying path H2 (Step S209). Then, a check is made as to whether or not a sheet or a pile of sheets are temporarily stored on the third conveying path H3 (Step S210). If a sheet or a pile of sheets are not stored, the sheet is conveyed downstream by the sixth and seventh conveying units 13 and 14 until the trailing edge of the sheet passes through the second detecting unit S2 (Steps S211 and S212). When the trailing edge of the sheet passes through the second detecting unit S2, the second branching unit t2 is switched to the side of the third conveying path H3 (Step S217) and the sixth, seventh, and eighth conveying units are rotated backward so that the sheet is conveyed upstream for a predetermined distance (Step S218) and the trailing edge of the sheet is conveyed to the third conveying path H3. When the leading edge of the sheet passes through the second detecting unit S2 and is conveyed for a predetermined distance (Yes at Step S219), the sixth and eighth conveying units 13 and 15 or the sixth to eighth conveying units 13 to 15 are stopped so that the sheet is stored at a predetermined position on the third conveying path H3 (Step S220). Then, the process returns to Step S201 and the subsequent steps are repeated.

Conversely, if a sheet or a pile of sheets are temporarily stored at Step S210, the leading edge of the subsequently conveyed sheet is overlapped with the leading edge of the temporarily stored sheet or pile of sheets by the eighth conveying unit 15, and the sixth and the seventh conveying units 13 and 14 are driven so that the sheet or pile of sheets are conveyed downstream until the trailing edges of the sheet or pile of sheets pass through the second detecting unit S2 (Steps S213 and S214). Then, a check is made as to whether or not the conveyed sheet is the last sheet of sheets to be temporarily stored (Step S215). If it is not the last sheet, the sheets are conveyed until the trailing edges of the sheets pass through the second detecting unit S2 (Step S216). After the trailing edges of the sheets have passed through the second detecting unit S2, the process after Step S217 is performed.

Conversely, if it is the last sheet to be temporarily stored at Step S215, the process proceeds to Step S205.

At Step S205, a check is made as to whether or not the creasing has been completed and, if the creasing has not been completed, the process returns to Step S201 and the subsequent steps are performed. If the creasing has been completed, a check is made as to whether or not all of the subsequent sheets (the inner sheets P1 to Pn) have been conveyed (Step S206). When all of the subsequent sheets have been conveyed, the cover Pc is conveyed downstream, i.e., to the processing tray 10 (Step S207) and then the pile of temporarily stored sheets is conveyed downstream (to the processing tray 10) (Step S208).

At that time, after the cover Pc has been conveyed downstream to the folding processing apparatus B, as described above, the complete pile of temporarily stored inner sheets P1 to Pn may be conveyed downstream to the folding processing apparatus B or may be conveyed together with the cover Pc for which the creasing process has been completed, in a stacked manner. Alternatively, after the cover Pc has been conveyed downstream, temporarily storing the inner sheets is continued, and when the last sheet Pn is conveyed, the last sheet Pn may be conveyed together with the pile of temporarily stored inner sheets P1 to Pn−1 so that the complete pile of inner sheets P1 to Pn is conveyed downstream.

Figure 37:
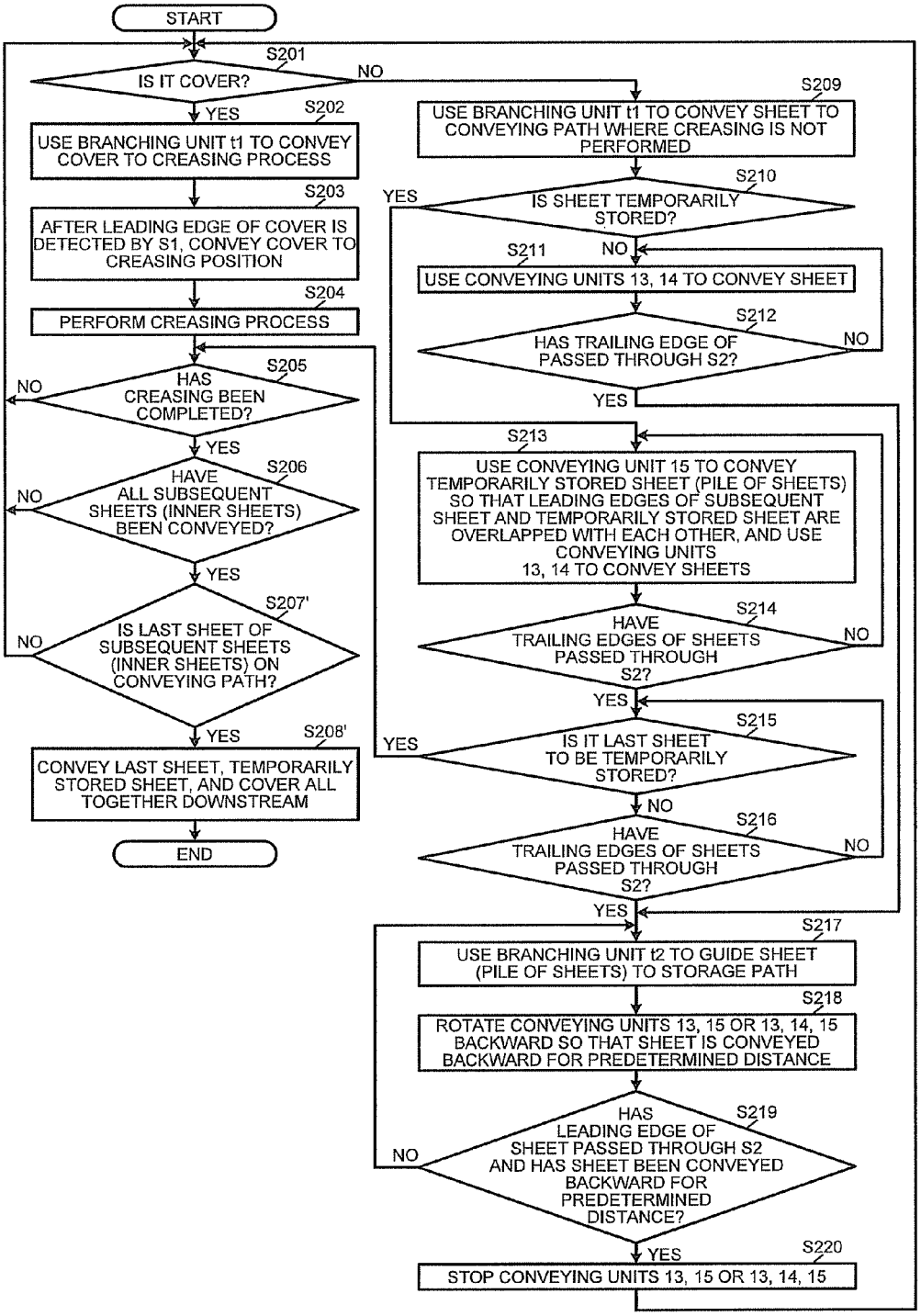
FIG. 37 is a flowchart that illustrates a procedure of the operation illustrated in FIG. 35.

FIG. 37 illustrates a procedure performed at that time. In the procedure, Step S207 in FIG. 36 is replaced by Step S207', and Step S208 in FIG. 36 is replaced by Step S208'. The other steps are the same as those in FIG. 36.

In the procedure, if all of the subsequent sheets (the inner sheets P1 to Pn) have been conveyed at Step S206 and if the last sheet of the subsequent sheets (the inner sheets) is on the conveying path (Yes at Step S207'), the last sheet, the temporarily stored sheet or pile of sheets, and the cover are conveyed all together downstream, i.e., to the processing tray 10 (Step S208').

In the above configuration, the order of sheets to be conveyed from the upstream image forming apparatus PR needs to be changed depending on the combination of the internal configurations of the folding processing apparatus B and the creasing apparatus A that are connected to the downstream side of the image forming apparatus PR. For example, in the configuration where a pile of sheets is turned over in the apparatus as illustrated in FIG. 20, when the booklet illustrated in FIG. 19 is to be created, it is necessary to store the sheets in the folding processing apparatus B in the following order: the innermost sheet ($n^{th}$ sheet), $n-1^{th}$ sheet, $n-2^{th}$ sheet, . . . , second sheet, first sheet, and finally cover Pc. If the creasing apparatus A has the configuration illustrated in FIG. 27, it is necessary to convey the sheets in the following order: the cover Pc, the innermost sheet ($n^{th}$ sheet), $n-1^{th}$ sheet, $n-2^{th}$ sheet, . . . , second sheet, and first sheet. In the case of the configuration illustrated in FIG. 26, it is necessary to convey the sheets in the following order: the cover Pc, first sheet, second sheet, $n-2^{th}$ sheet, $n-1^{th}$ sheet, and innermost sheet ($n^{th}$ sheet).

Thus, the order of sheets to be conveyed from the image forming apparatus PR to the creasing apparatus A needs to be changed depending on the configurations of the creasing apparatus A and the downstream folding processing apparatus B; however, the cover Pc always needs to be the first sheet to be conveyed.

If the folding process is performed off-line, it is necessary to convey sheets in the order the pages are set in the folding processing apparatus in order to maintain the productivity. Therefore, it is advantageous in terms of the productivity to include a determining unit that automatically determines the order of sheets to be output from the image forming apparatus by using the type or function of a post-processing apparatus, such as the folding processing apparatus B that is included in the system, or to include a selecting unit by which a user can decide the order of sheets depending on an off-line post-processing apparatus.

The time from when the reading of documents is started to when all sheets are discharged from the creasing apparatus A is different when creating a plurality of booklets and when creating only one booklet. For example, the booklet illustrated in FIG. 19 is to be created by using the configuration illustrated in FIG. 20. Even if the documents are read in the following order: the innermost sheet ($n^{th}$ sheet), $n-1^{th}$ sheet, $n-2^{th}$ sheet, . . . , second sheet, first sheet, and cover Pc, it is necessary to convey the cover after all of the documents have been read because the cover needs to be first conveyed to the creasing apparatus A, and then it is necessary to output the sheets in the following order: the innermost sheet ($n^{th}$ sheet), $n-1^{th}$ sheet, $n-2^{th}$ sheet, . . . , second sheet, and first sheet. If one booklet is to be created, the sheets are output in the order the documents are read; thus, the time from when the reading of documents is started to when all of the sheets are output may be shortened.

The overall time is different depending on the number of documents to be read (the number of sheets to be output), the time it takes to perform the creasing process, the overall output amount (the number of booklets), or the like. Therefore, the quickest output form is determined by using the above information and sheets are output by using the output form so that the overall amount of time can be shortened.

As described above, according to the present embodiment, if a booklet to be created includes a sheet on which a creasing process is to be performed and a sheet on which the creasing process is not to be performed, e.g., if a combination of a cover on which the creasing process is to be performed and an inner sheet on which the creasing process is not to be performed is processed according to one job, the subsequent sheet is conveyed downstream by using a different conveying path while, the creasing process is being performed on a sheet, and the sheet for which the creasing process has been completed is then conveyed downstream, or the subsequent sheet is temporarily stored on a different conveying path while the creasing process is being performed on the sheet and the subsequent sheet is then conveyed downstream together with the sheet for which the creasing process has been completed; thus, continuously conveyed sheets can be received without stopping the sheets. Therefore, even if the creasing process requires a certain time of period, the folding process and the bookbinding process can be performed without decreasing the productivity of creating booklets.

According to an aspect of the present invention, it is possible to selectively convey sheets via a conveying path where creasing is performed and convey sheets via a conveying path where creasing is not performed; thus, high productivity can be maintained while a creasing process is performed and the quality of a folding process that is performed after the creasing process can be improved.

The present invention is characterized in that, even though it is necessary to perform a creasing process that requires a certain period of time, it is possible to receive sheets that are continuously conveyed, which can maintain productivity.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A creasing apparatus that performs a creasing process on a sheet, the creasing apparatus comprising:

a first conveying path on which a creasing unit is located, the creasing unit performing a creasing process on a sheet conveyed therein;

a second conveying path that conveys a sheet conveyed therein to a downstream side without any process being performed on the sheet; and a control unit that, while the first conveying path conveys a sheet so that the creasing unit performs the creasing process on the sheet, causes a subsequent sheet to be conveyed to the downstream side from the second conveying path, wherein, when the creasing process is performed on an cover of a booklet, the control unit first causes the cause of the booklet to be received by the first conveying path so that the creasing process is performed and, while the creasing process is being performed, causes subsequent sheet to be sequentially received by the second conveying path.

2. The creasing apparatus according to claim 1, wherein when a sheet that has been conveyed through the first conveying path and that has been subjected to the creasing process is conveyed downstream, the control unit causes the sheet to be stacked together with a subsequent sheet that is conveyed through the second conveying path without any process being performed and causes the sheets to be conveyed downstream.

3. An image forming system comprising:

the creasing apparatus according to claim 1;

an image forming apparatus that is connected to the upstream side of the creasing apparatus; and a folding apparatus that is connected to the downstream side of the creasing apparatus.

4. An image forming system comprising:

the creasing apparatus according to claim 1;

an image forming apparatus that is connected to the upstream side of the creasing apparatus; and a folding apparatus that is connected to the downstream side of the creasing apparatus, wherein the control unit determines a receiving order of the subsequent sheets to be received depending on a system configuration.

5. The image forming system according to claim 4, wherein the control unit determines the receiving order depending on an order of a creasing process that completes creation of a booklet in the shortest time after reading of a document is started.

6. The image forming system according to claim 3, further comprising an input unit by which a user makes an input to set the receiving order of the subsequent sheets to be received, wherein the control unit determines the receiving order to be the receiving order that is set through the input unit.

7. A creasing apparatus that performs a creasing process on a sheet; the creasing apparatus comprising:

a first conveying path on which a creasing unit is located, the creasing unit performing a creasing process on a sheet conveyed therein;

a second conveying path that conveys a sheet conveyed therein to a downstream side without any process being performed on the sheet; and a control unit that, while the first conveying path conveys a sheet so that the creasing unit performs the creasing process on the sheet, causes a subsequent sheet to be temporarily stored on the second conveying path and then causes the subsequent sheet to be conveyed to the downstream side.

8. The creasing apparatus according to claim 7, wherein the second conveying path includes a third conveying path where a previous sheet waits until a subsequent sheet is conveyed to the second conveying path, wherein while the creasing process is being performed on the first conveying path, the control unit causes the previous sheet to be temporarily stored on the conveying path where the creasing process is not performed and then causes the previous sheet together with the subsequent sheet conveyed to the second conveying path to be conveyed downstream.

9. The creasing apparatus according to claim 7, wherein, when the creasing process is performed on a cover of a booklet, the control unit first causes the cover of the booklet to be received by the first conveying path so that the creasing process is performed and, while the creasing process is being performed, causes subsequent sheets to be sequentially received by the second conveying path.

10. An image forming system comprising:

the creasing apparatus according to claim 7;

an image forming apparatus that is connected to the upstream side of the creasing apparatus; and a folding apparatus that is connected to the downstream side of the creasing apparatus.

11. An image forming system comprising:

the creasing apparatus according to claim 9;

an image forming apparatus that is connected to the upstream side of the creasing apparatus; and a folding apparatus that is connected to the downstream side of the creasing apparatus, wherein the control unit determines a receiving order of the subsequent sheets to be received depending on a system configuration.

12. The image forming system according to claim 11, wherein the control unit determines the receiving order depending on an order of a creasing process that completes creation of a booklet in the shortest time after reading of a document is started.

13. The image forming system according to claim 10, further comprising an input unit by which a user makes an input to set the receiving order of the subsequent sheets to be received, wherein the control unit determines the receiving order to be the receiving order that is set through the input unit.

* * * * *